US006938838B2

(12) United States Patent
Kawamoto

(10) Patent No.: US 6,938,838 B2
(45) Date of Patent: Sep. 6, 2005

(54) NOZZLE AND ASPIRATOR WITH NOZZLE

(75) Inventor: Eiichi Kawamoto, Fukuyama (JP)

(73) Assignee: Sanyo Rayjac Co., Ltd., Tokyo (JP)

( * ) Notice: Subject to any disclaimer, the term of this patent is extended or adjusted under 35 U.S.C. 154(b) by 630 days.

(21) Appl. No.: 09/730,754

(22) Filed: Dec. 7, 2000

(65) Prior Publication Data

US 2001/0003353 A1 Jun. 14, 2001

(30) Foreign Application Priority Data

| | | |
|---|---|---|
| Dec. 10, 1999 | (JP) | 11-350930 |
| Mar. 2, 2000 | (JP) | 2000-057548 |
| Mar. 2, 2000 | (JP) | 2000-057637 |
| Mar. 14, 2000 | (JP) | 2000-070193 |
| Mar. 30, 2000 | (JP) | 2000-093891 |
| Apr. 20, 2000 | (JP) | 2000-118926 |

(51) Int. Cl.[7] ..... B05B 1/26

(52) U.S. Cl. ..... 239/504; 239/505; 239/507; 239/509; 239/119; 239/120

(58) Field of Search ..... 239/119, 120, 239/504, 510, 509, 507, 505

(56) References Cited

U.S. PATENT DOCUMENTS

| | | | | |
|---|---|---|---|---|
| 2,232,218 A | | 2/1941 | Doty | |
| 3,705,437 A | | 12/1972 | Rukavina, Jr. et al. | |
| 3,853,621 A | | 12/1974 | Sollerud | |
| 3,861,594 A | * | 1/1975 | Wendling | 239/1 |
| 4,023,233 A | * | 5/1977 | Prestwich | 15/320 |
| 4,083,705 A | | 4/1978 | Parise et al. | |
| 4,282,626 A | | 8/1981 | Schneider | |
| 4,696,075 A | | 9/1987 | Grave | |
| 5,589,080 A | | 12/1996 | Cho et al. | |
| 5,640,739 A | | 6/1997 | Campbell | |
| 6,224,656 B1 | * | 5/2001 | Kawamoto | 96/331 |

FOREIGN PATENT DOCUMENTS

| | | |
|---|---|---|
| DE | A.2 537 004 | 3/1977 |
| DE | 4122527 | 7/1992 |
| DE | 19522893 | 2/1996 |
| FR | A.2 264 510 | 10/1975 |
| JP | 61-22570 | 2/1986 |
| JP | 10-304993 | 11/1998 |
| JP | 11-019603 | 1/1999 |
| JP | 11-019603 | 2/1999 |
| JP | 2000-051313 | 2/2000 |
| JP | 2000-070325 | 3/2000 |
| WO | WO 92/22276 | 12/1992 |
| WO | WO 01/53001 | 7/2001 |

OTHER PUBLICATIONS

*Notification of Reason for Refusal* for Japanese Patent Application No. 2000–57548, dated May 28, 2002, Japanese Patent Office, and English Translation.
*Notification of Reason for Refusal* for Japanese Patent Application No. 2000–57637, dated May 28, 2002, Japanese Patent Office, and English Translation.
European Search Report dated May 3, 2004.
European Search Report dated Oct. 16, 2003.
European Search Report dated Jul. 24, 1992.
European Patent Office Examination Report 03 252 237.7.

* cited by examiner

*Primary Examiner*—Christopher Kim
(74) *Attorney, Agent, or Firm*—Nixon Peabody LLP

(57) ABSTRACT

The present invention provides a nozzle capable of easily removing an aspiration object (residual solidified object) and an aspirator equipped with such a nozzle. This nozzle is connected to the aspirator and is used to aspirate the aspiration object. The nozzle comprises: a nozzle body including an opening, which can be opposed to a surface with the residual aspiration object, and a suction port for aspirating the aspiration object; and a liquid injection mechanism, which is provided at the nozzle body, for ejecting liquid toward the aspiration object.

15 Claims, 25 Drawing Sheets

NOZZLE AND ASPIRATOR WITH NOZZLE

BACKGROUND OF THE INVENTION

1. Field of the Invention

The present invention relates to the structure of a nozzle which is used for, for example, the care of elderly persons, more specifically, for the aspiration and removal of residual excrements on the bodies of elderly persons, and this invention also relates to an aspirator with such a nozzle.

2. Description of the Related Art

Pursuant to Because of rising average life expectancies and development of medical technology, the number of persons, particularly elderly persons, who need care because they are bedridden or they suffer from dementia has been increasing sharply these days. Accordingly, the care of such persons, particularly the disposal of excrements, has become a very important issue.

Diapers are generally used for the disposal of excrements of persons who need care because of, for example, a bedridden condition or dementia. Specifically speaking, the disposal of excrements of the persons who need care is conducted by changing diapers after evacuation or regularly.

However, just changing diapers will leave residual excrements on the body, giving rise to problems in terms of sanitary management. Accordingly, it is necessary to remove the residual excrements on the body of a person who needs care when changing diapers. Such a task has been conducted by using cleaning items made of paper or cloth materials. Namely, the present way of removing the residual excrements is to directly wipe a feculent part of the body of an elderly person by using the above-mentioned cleaning items.

However, the residual excrements on the body often solidify by the time of changing diapers and a large amount of labor is required for the removal of the excrements.

SUMMARY OF THE INVENTION

It is an object of the present invention to provide a nozzle capable of easily removing an object to be aspirated (or residual solidified object) (hereinafter referred to as the "aspiration object"), and an aspirator equipped with such a nozzle. More particularly, it is an object of this invention to provide a nozzle capable of easily aspirating and removing the residual aspiration object (or solidified object) on the human body, and an aspirator equipped with such a nozzle.

In order to achieve the above-described objects, this invention provides a nozzle connected to an aspirator and used for aspirating an aspiration object, the nozzle comprising: a nozzle body including an opening, which can be opposed to a surface with the residual aspiration object thereon, and a suction port for aspirating the aspiration object; and a liquid injection mechanism, which is provided at the nozzle body, for ejecting liquid toward the aspiration object.

The nozzle structured in the above-described manner can spray the liquid (or cause the liquid to act) on the aspiration object efficiently.

As a mode of this invention, an outside-air inlet for introducing outside air into the nozzle body can be formed on an end face of the opening, which is opposed to the surface with the residual aspiration object.

If the nozzle is structured in this manner, the outside air is introduced into the nozzle through the outside-air inlet formed at the nozzle body during the aspiration of the aspiration object. Accordingly, the inside of the nozzle body will never be depressurized significantly. As a result, the nozzle body will not adsorb so strongly to the surface with the residual aspiration object to cause a problem. Therefore, if the nozzle having the structure of this invention is used, it is possible to conduct the operation more easily to move the nozzle over the surface with the residual aspiration object during the aspiration. Moreover, during the aspiration, as described above, the outside air is introduced into the nozzle with substantial force. In other words, a strong inward flow of the outside air is formed at the outside-air inlet. Consequently, if the liquid is sprayed onto the aspiration object within the nozzle, the liquid hits the surface with the residual aspiration object and disperses, but is then pushed back by the flow of outside air. Therefore, the liquid will never disperse out of the nozzle through the outside-air inlet. As a result, it is possible to perform the task in a good environment without soiling the surroundings.

A plurality of projections can be formed in a peripheral direction of the end face of the opening and spaces between the projections can constitute the outside-air inlets.

Moreover, the liquid injection mechanism can eject the liquid in a slanting direction relative to the surface with the residual aspiration object.

Furthermore, a liquid injection hole for ejecting the liquid toward the aspiration object can be formed around the opening and on the end face opposed to the aspiration object. (A plurality of such liquid injection holes can be formed particularly in a peripheral direction.) Specifically, such a structure is preferred for the aspiration and removal of the residual aspiration object (e.g., excrements) around a protrusion (e.g., male genital organs).

As another mode of this invention, the nozzle can be structured in such a manner that the liquid injection mechanism comprises a barrier plate provided within the nozzle body and substantially in parallel with the opening, and the barrier plate has a smaller surface area than a sectional area of a cavity of the nozzle body at the position where the barrier plate is provided, and the barrier plate has a liquid injection hole formed therein for ejecting the liquid toward the aspiration object.

If the nozzle is structured in this manner, the liquid is sprayed through the liquid injection hole in the barrier plate toward the aspiration object. This sprayed liquid collides with the aspiration object (or the surface with the residual aspiration object) and then splashes back toward the deep end of the nozzle. As described above, the nozzle having the structure of this invention has the barrier plate within the nozzle body and substantially in parallel with the opening which is opposed to the aspiration object. Accordingly, the splashed liquid splashes back again toward the side of the aspiration object because of the existence of the barrier plate. This action is then repeated with attenuation. On the other hand, a flow of air toward the deep end of the nozzle is produced within the nozzle because of the aspiration. Therefore, the liquid ejected from the liquid injection hole flows toward the peripheral side of the barrier plate as it splashes back and forth between the barrier plate and the surface with the residual aspiration object. Consequently, by using the nozzle having the structure of this invention, it is possible to spray the liquid toward (or to cause the liquid to act on) the aspiration object very efficiently as compared with a method of ejecting liquid toward a certain spot. Specifically, it is possible to spray the liquid (or to cause the liquid to work) with force in a wide range (with the same area as that of the barrier plate) at once.

Moreover, the liquid injection hole can be formed in a surface of the barrier plate, which is opposed to the surface with the residual aspiration object. Furthermore, on the surface of the barrier plate, which is opposed to the surface with the residual aspiration object, a projection can be formed in an area where the liquid injection hole is not formed. This structure allows the liquid flowing toward the peripheral side of the barrier plate to be further agitated, thereby enabling the improved efficiency of removal of the aspiration object.

The nozzle can be structured in such a manner that the barrier plate is supported within the nozzle body by a hollow stay mounted on an inner surface of the nozzle body, and the liquid is supplied through the inside of the stay to the liquid injection hole in the barrier plate.

As still another mode of this invention, the nozzle can be structured in such a manner that the liquid injection mechanism has: a liquid injection hole for ejecting the liquid in a direction substantially in parallel with the surface with the residual aspiration object when the opening is opposed to the surface with the residual aspiration object; and a barrier member provided in such a manner that at least a part of the barrier member is opposed to the liquid injection hole; wherein the suction port is located between the liquid injection hole and the barrier member, and the liquid ejected from the liquid injection hole collides with the barrier member and the collided liquid is aspirated through the suction port.

If the nozzle is structured in this manner, a flow of the liquid is reversed during the aspiration of the aspiration object. In other words, since the liquid circulates without ejecting outside, the liquid will never disperse even if the nozzle is moved away by mistake from the surface with the residual aspiration object while the liquid is being ejected. Accordingly, it is possible to conduct the task in a good environment without soiling the surroundings. Moreover, the liquid is sprayed on the aspiration object to be aspirated and removed over the surface with the residual aspiration object. Therefore, it is possible to spray the liquid (or to cause the liquid to act) on the aspiration object very efficiently.

Moreover, the nozzle can be structured in such a manner that a perforating hole is formed in a surface of the nozzle body between the liquid injection hole and the suction port, the surface being opposed to the opening, and the perforating hole is capable of introducing outside air into the nozzle body.

Particularly with the type of the nozzle structured to have the outside air introduced into the nozzle body through the perforating hole, the liquid ejected from the liquid injection hole is forcibly pushed toward the side of the aspiration object by the pressure of the outside air introduced (or blowing) through the perforating hole. As a result, the ejected liquid washes down the aspiration object with more certainty. In other words, the liquid acts on the aspiration object more effectively, thereby exhibiting highly excellent aspiration and removal performance.

Furthermore, a projection can be formed on a surface of the nozzle body between the liquid injection hole and the suction port, the surface being opposed to the opening. Consequently, if the surface with the residual aspiration object is soft (particularly if it is the surface of the human body), it is possible to prevent the end face of the opening of the nozzle body from sticking to the surface with the residual aspiration object. Namely, it is possible to securely form a space necessary for the treatment to aspirate and remove the aspiration object.

When the perforating hole is made, the projection is formed at a position where the perforating hole does not exist. As a matter of fact, the projection is formed at such a position (and/or in such a shape) that it may not collide with the liquid ejected from the liquid injection hole.

The barrier member can be structured to have a cross section shaped substantially in the letter U, which defines a part of the opening. In this case, the liquid ejected from the liquid injection hole collides with the center portion (bend portion) of the substantially U-shaped barrier member, thereby preventing the liquid from dispersing more effectively.

It is also possible to form undulant irregularities on a face of the barrier member, which is opposed to the surface with the residual aspiration object. This structure allows the outside air to be introduced into the nozzle body more actively. Therefore, it is possible to prevent the nozzle from excessively adsorbing to the surface with the residual aspiration object (particularly the surface of the human body).

As a further mode of this invention, the nozzle can be structured in such a manner that the liquid injection mechanism comprises a shielding member provided in a displaceable manner relative to the nozzle body, wherein the shielding member has a shielding plate which blocks a part of the opening and with which the ejected liquid can collide, and wherein when the shielding member is displaced in a direction to move the shielding plate closer to the opening, the ejected liquid is discharged outside without colliding with the shielding plate, but when the shielding member is displaced in a direction to move the shielding plate away from the opening, the ejected liquid collides with the shielding plate.

If the nozzle is structured in this manner, the shielding member of the nozzle is pushed against the surface with the residual aspiration object while the aspiration object is being aspirated. Specifically speaking, the shielding member is displaced in a direction to move the shielding plate closer to the opening of the nozzle body and, therefore, the liquid ejected from the liquid injection mechanism is sprayed on the aspiration object without any shielding so that the aspiration object is quickly detached. As a result, excellent ability of aspiration and removal is exhibited.

If the nozzle is moved away from the surface with the residual aspiration object while the liquid is being ejected, the power to push the shielding member of the nozzle against the surface with the residual aspiration object is released. Accordingly, the shielding member can return to the original position (the position in a natural state). As a result, the liquid ejected from the liquid injection device is blocked by the shielding plate. In other words, the liquid ejected from the liquid injection device collides with the shielding plate and the liquid droplets are then immediately aspirated. Consequently, even if the nozzle is moved away from the surface with the residual aspiration object during the aspiration work while the liquid is being ejected, the liquid will never disperse around. Therefore, such a problem of soiling the surroundings with the dispersed liquid will not occur.

In addition, in order to achieve such special effects, it is unnecessary for the nozzle of this invention to incorporate a complicated control system which employs, for example, a sensor. Accordingly, the structure of the nozzle is very simple and it is possible to provide such a nozzle at low cost.

The nozzle body can be connected with the shielding member through an urging member for urging the shielding plate and the opening away from each other. Examples of this urging member include a coil spring and a plate spring.

Accordingly, if the power to displace (or push back) the shielding member is released, the shielding plate of the shielding member immediately returns (or advances) to the position where the shielding plate collides with the liquid. As a result, it is possible to prevent the dispersion of the liquid with more certainty, as compared with the prior art in which the dispersion of the liquid occurs when the nozzle is moved away from the surface with the residual aspiration object.

The nozzle can be structured in such a manner that at least a center portion of the shielding plate is tapered so as to become narrower and contracts toward the deep end of the nozzle body, and when the shielding member is displaced in a direction to move the shielding plate closer to the opening, the liquid is discharged outside from an aperture existing at the center of the shielding plate.

By making the shielding plate in the above-described shape, a space is formed between the shielding plate and the surface with the residual aspiration object. Accordingly, it is possible to have the liquid act also on an area opposed to the shielding plate, that is, to aspirate and remove the aspiration object existing in such an area at the same time, thereby further improving the working efficiency. Moreover, an effective suction force also acts on the space, thereby achieving the effect of making it difficult for the liquid to remain in the area opposed to the shielding plate.

If the shielding plate is formed in a tapered shape as described above, the surface of the shielding plate may be, for example, bent in its oblique direction or be straight in its oblique direction. More particularly, the shielding plate should not necessarily be in a three-dimensional shape, but may simply be a flat plate (perpendicular to the axial direction of the nozzle body).

Moreover, the liquid injection mechanism can be structured to eject the liquid, which is to be ejected toward the aspiration object, over a virtual conical surface, the tip of the liquid injection mechanism forming a vertex of the virtual cone. When the liquid is ejected in this manner, the liquid may be ejected in such an atomized form that a continuous conical surface can be formed, or as several stream lines flowing over the conical surface.

Furthermore, a plurality of projections can be formed in a peripheral direction on an end face of the shielding member, which is opposed to the surface with the residual aspiration object. This allows the outside air to be actively introduced into the nozzle during the aspiration and removal work. Therefore, it is possible to avoid the nozzle from excessively adsorbing to the surface with the residual aspiration object (particularly the surface of the human body). As a result, it is possible to conduct the operation very easily to move the nozzle over the surface with the residual aspiration object.

If the nozzle which adopts the above-described structure is used for the treatment of aspiration and removal of the residual aspiration object on the surface of the human body, it is desirable that the top end side of the projection be rounded, that is, the top end side of the projection be formed, for example, in a hemispherical shape in order not to damage the skin.

As a still further mode of this invention, the nozzle can be structured in such a manner that the liquid injection mechanism comprises: a shielding plate which is provided within the nozzle body, which is displaceable in a direction perpendicular to an axial direction of the nozzle body, and with which the ejected liquid can collide; and a driving mechanism connected to the shielding plate and designed to displace the shielding plate by utilizing a pressure difference between a pressure within the nozzle body and atmospheric pressure when the pressure within the nozzle body becomes a negative pressure; wherein the driving mechanism operates and displaces the shielding plate, thereby the ejected liquid is discharged outside without colliding with the shielding plate.

The nozzle can be structured in such a manner that the shielding plate has a notch, and when the driving mechanism operates and displaces the shielding plate, the liquid ejected from the liquid injection mechanism passes through the notch.

In the case of this structure, the driving mechanism can comprise: an annular guide wall mounted around a hole formed in an outer surface of the nozzle body; a piston member provided in the guide wall so as to be displaceable relative to the guide wall; a shaft member for connecting the piston member with the shielding plate; and a restoring member for exerting a restoring force on the piston member in a direction so as to move the piston member away from the inside space of the nozzle body; wherein when the pressure within the nozzle body becomes a negative pressure, the piston member is displaced by means of a pressure difference between the negative pressure and atmospheric pressure in a direction so as to move the piston member closer to the inside space of the nozzle body, and the displacement of the piston member causes the shielding plate to be displaced through the intermediary of the shaft member.

As a still further mode of this invention, the nozzle can be structured in such a manner that the liquid injection mechanism comprises: a shielding plate which is provided within the nozzle body so as to block a part of the opening of the nozzle body, and with which the liquid ejected from the liquid injection mechanism can collide; and a driving mechanism connected to the liquid injection mechanism and designed to tilt the liquid injection mechanism by utilizing a pressure difference between a pressure within the nozzle body and atmospheric pressure when the pressure within the nozzle body becomes a negative pressure; wherein the driving mechanism operates and tilts the liquid injection mechanism, thereby the liquid ejected from the liquid injection mechanism is discharged outside without colliding with the shielding plate.

In the case of this structure, the nozzle can be structured in such a manner that the driving mechanism comprises: an annular guide wall mounted around a hole formed in an outer surface of the nozzle body; a piston member provided in the guide wall so as to be displaceable relative to the guide wall; a shaft member for connecting the piston member with the liquid injection mechanism; and a restoring member for exerting a restoring force on the piston member in a direction so as to move the piston member away from the inside space of the nozzle body; wherein when the pressure within the nozzle body becomes a negative pressure, the piston member is displaced by means of a pressure difference between the negative pressure and atmospheric pressure in a direction so as to move the piston member closer to the inside space of the nozzle body, and the displacement of the piston member tilts the liquid injection mechanism through the intermediary of the shaft member.

The guide wall can be formed at such a position that the piston member existing inside the guide wall can be pressed with a finger. This structure allows the liquid to be ejected manually as necessary. In more detail, this structure can deal with the situation where the nozzle cannot be made to contact the surface with the residual aspiration object, that is, the situation where a sufficient negative pressure cannot be achieved. Specifically, it is possible to aspirate and remove residual excrements on the sore skin of a person, for example, who has been bedridden for a long time and needs care, without inflicting hardly any pain to the person.

An open side of the guide wall, which is opposed to a principal plane of the piston member, can be blocked by a film member which is impermeable to gas. (However, a hole of about a pinhole size may exist.) This blocks the intake of the outside air through the open side of the guide wall and, therefore, it is possible to further increase a pressure difference between the atmospheric pressure and the negative pressure. As a result, the driving mechanism functions with more reliability.

Moreover, a plurality of projections can be formed in a peripheral direction on the end face of the opening. This structure allows the outside air to be introduced into the nozzle through spaces between the projections during the aspiration and removal work. Accordingly, it is possible to avoid the nozzle from excessively adsorbing to the surface with the residual aspiration object (particularly the surface of the human body). As a result, it is possible to conduct the operation very easily to move the nozzle over the surface with the residual aspiration object.

In the case of this structure, it is also desirable, as described above, that the top end side of the projection be rounded.

With the type of nozzle having the liquid injection mechanism tilted, the shielding plate may be set either in parallel with or in a slanting direction relative to the opening face of the nozzle body. However, it is rather desirable that the shielding plate be mounted slantingly. This allows a space to be formed between the surface with the residual aspiration object and the shielding plate. Accordingly, it is possible to cause the liquid to act also on the area opposed to the shielding plate (the area on the surface with the residual aspiration object). As a result, the working efficiency is further improved. In addition, since the suction force effectively acts also on this area, the liquid will not remain.

If the nozzle connected to the aspirator and used for aspirating the aspiration object is structured in the above-described manner, the pressure within the nozzle body becomes a negative pressure during the work to aspirate the aspiration object (while the nozzle body is made in contact with the surface with the residual aspiration object) and, therefore, the shielding plate is displaced or the liquid injection mechanism is tilted. Subsequently, the liquid ejected from the liquid injection device no longer collides with the shielding plate, but is discharged outside from the opening of the nozzle body. In other words, the ejected liquid can be sprayed on the aspiration object without any shielding and the aspiration object can be removed quickly from the surface with the residual aspiration object. As a result, an excellent aspiration and removal ability can be exhibited.

If the nozzle is moved away from the surface with the residual aspiration object while the liquid is being ejected, the pressure within the nozzle body immediately increases. In other words, the pressure difference between the atmospheric pressure and the internal pressure (negative pressure) of the nozzle body decreases to a value equal to or less than an operating threshold value of the driving mechanism. Namely, the effective negative pressure is no longer formed within the nozzle body. Consequently, the shielding plate or the liquid injection mechanism returns to its original position and the liquid ejected from the liquid injection mechanism collides with and is blocked by the shielding plate, and the liquid droplets are then immediately aspirated. As a result, the liquid ejected from the liquid injection device will not be discharged outside from the opening of the nozzle body. Accordingly, even if the nozzle is moved away from the surface with the residual aspiration object during the aspiration work while the liquid is being ejected, the liquid will not disperse around. Therefore, such a problem of soiling the surroundings with the dispersed liquid will not occur.

Moreover, the liquid injection mechanism can eject the liquid in a slanting direction relative to the surface with the residual aspiration object.

A liquid injection hole for ejecting the liquid toward the aspiration object can also be formed around the opening of the nozzle body and on the end face opposed to the aspiration object.

Examples of the aspiration object include residual excrements and dirt on the human body.

This invention also provides an aspirator equipped with the aforementioned nozzle, and the aspirator comprises: an aspirating mechanism communicating with the suction port of the nozzle; an aspiration object tank for storing the aspiration object aspirated through the nozzle by operation of the aspirating mechanism; and a liquid supply mechanism for supplying liquid to the liquid injection mechanism of the nozzle; wherein the liquid sprayed from the liquid injection mechanism on the aspiration object, and the aspiration object are aspirated through the suction port of the nozzle by the operation of the aspirating mechanism and are then stored in the aspiration object tank.

The liquid supply mechanism can comprise: a liquid tank for storing the liquid; a liquid communicating passage for making the liquid tank communicate with the liquid injection mechanism; and a liquid pumping mechanism for pumping the liquid stored in the liquid tank into the liquid injection mechanism.

The aspirator can further comprise an aspiration passage for making the aspiration object tank communicate with the nozzle.

The aspirator structured in this manner can easily deal with the case where the aspiration object to be aspirated and removed has already solidified. Specifically, the residual aspiration object (solidified object) softens by the action of the liquid sprayed thereon and quickly comes off the attached position (the detachment is promoted with an impetus of the liquid sprayed thereon). As a result, it is possible to easily remove (aspirate and remove) the aspiration object (residual solidified object). More particularly, it is possible to aspirate and remove the residual solidified object (aspiration object) on the human body easily and efficiently.

Since the aspirator of this invention comprises the nozzle of this invention, it is possible to spray the liquid and to aspirate and remove the aspiration object within the nozzle at the same time. Accordingly, the liquid sprayed on the aspiration object and the aspiration object which comes off the attached position by the action of the liquid will not disperse around, thereby realizing a cleaner work environment.

The aspirator of this invention can further comprise a heating mechanism for heating the liquid stored in the liquid tank to a given liquid temperature. If the heated liquid is used, the removal (detachment) of the solidified aspiration object is further facilitated. Moreover, if the heated liquid is used, when the liquid is sprayed on the human body, it will not discomfort the person with coldness.

The nozzle may either be fixed at the aspirator or be provided in a detachable manner.

DETAILED DESCRIPTION OF THE PREFERRED EMBODIMENTS

Preferred embodiments of this invention are hereinafter explained with reference to the attached drawings.

(Embodiment 1)

An explanation is first given about an aspirator equipped with a nozzle of this invention.

Figure 1:
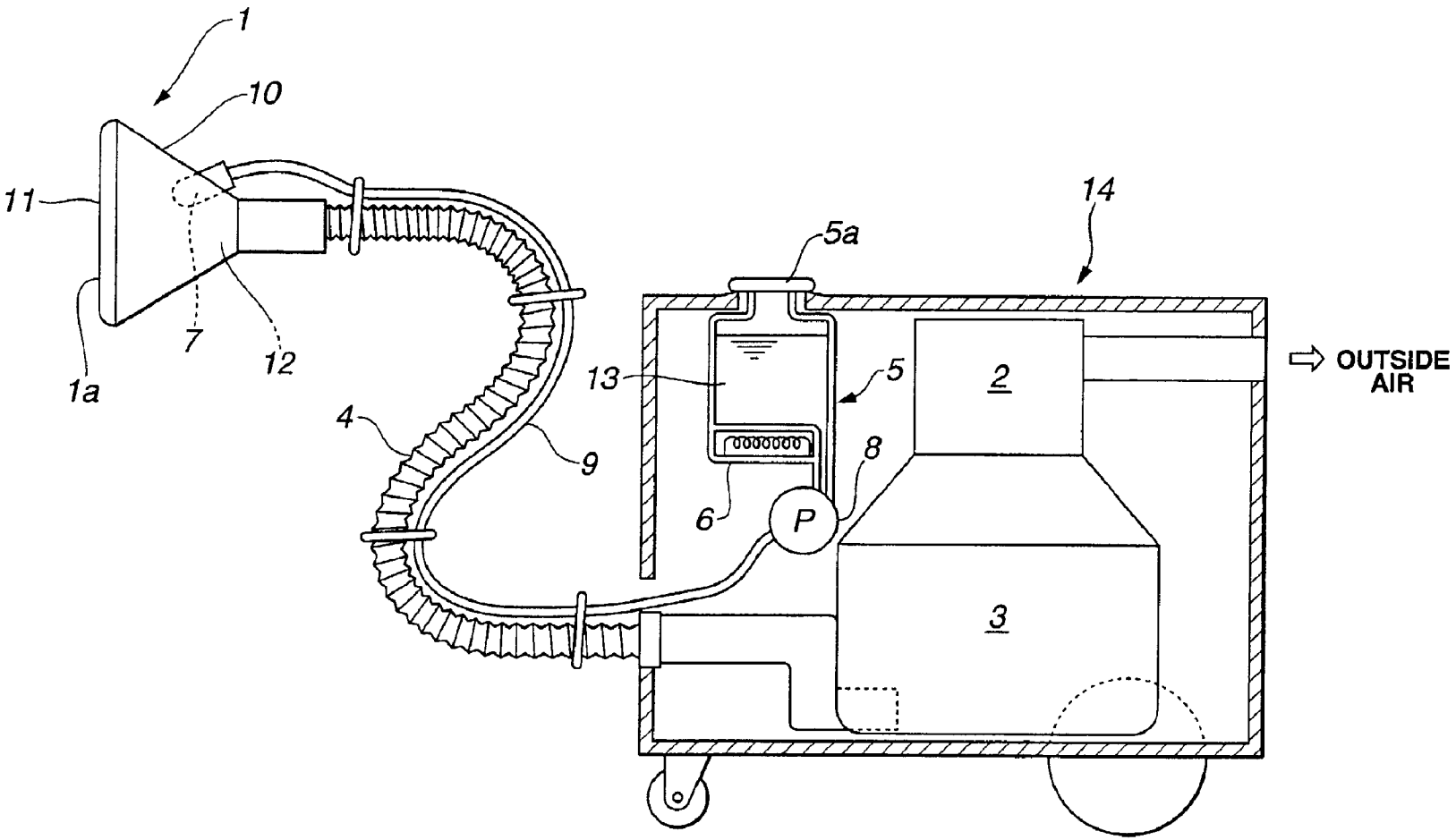
FIG. 1 is a schematic view of the structure of an aspirator according to Embodiment 1 of this invention.
Figure 2:
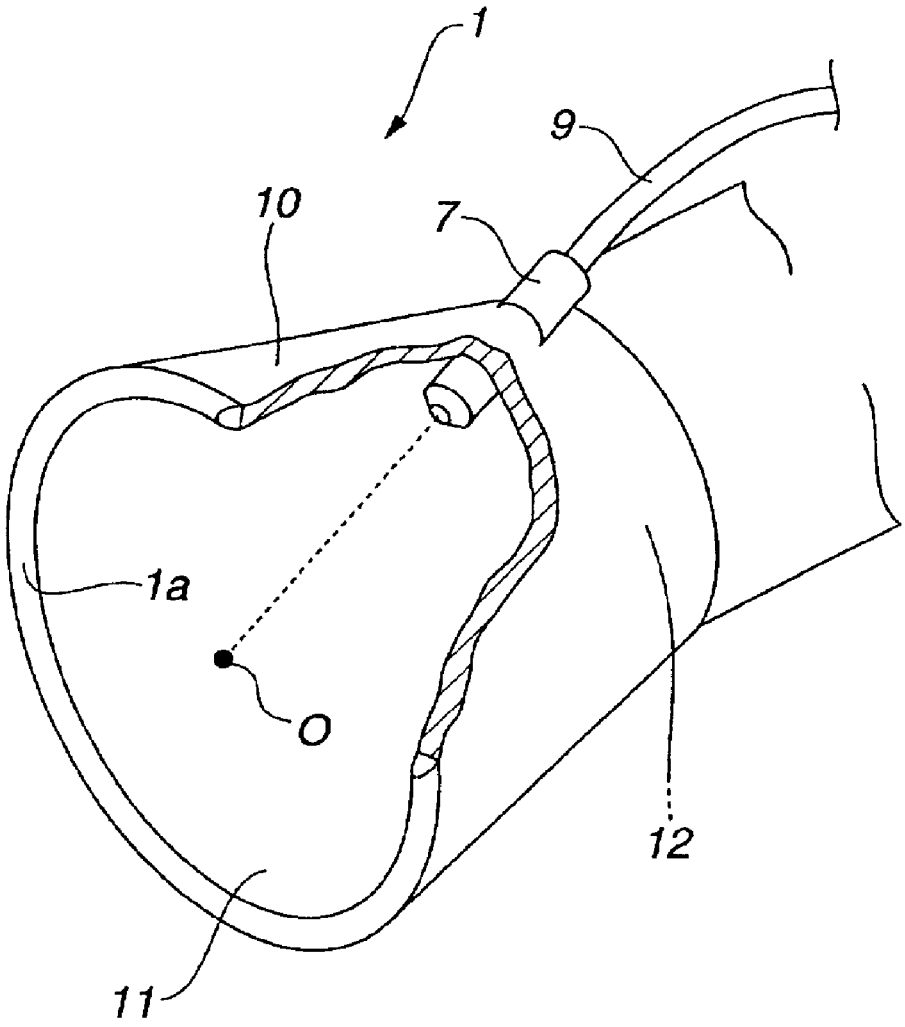
FIG. 2 is a perspective view of a nozzle part of the aspirator according to Embodiment 1 of this invention.
Figure 3:
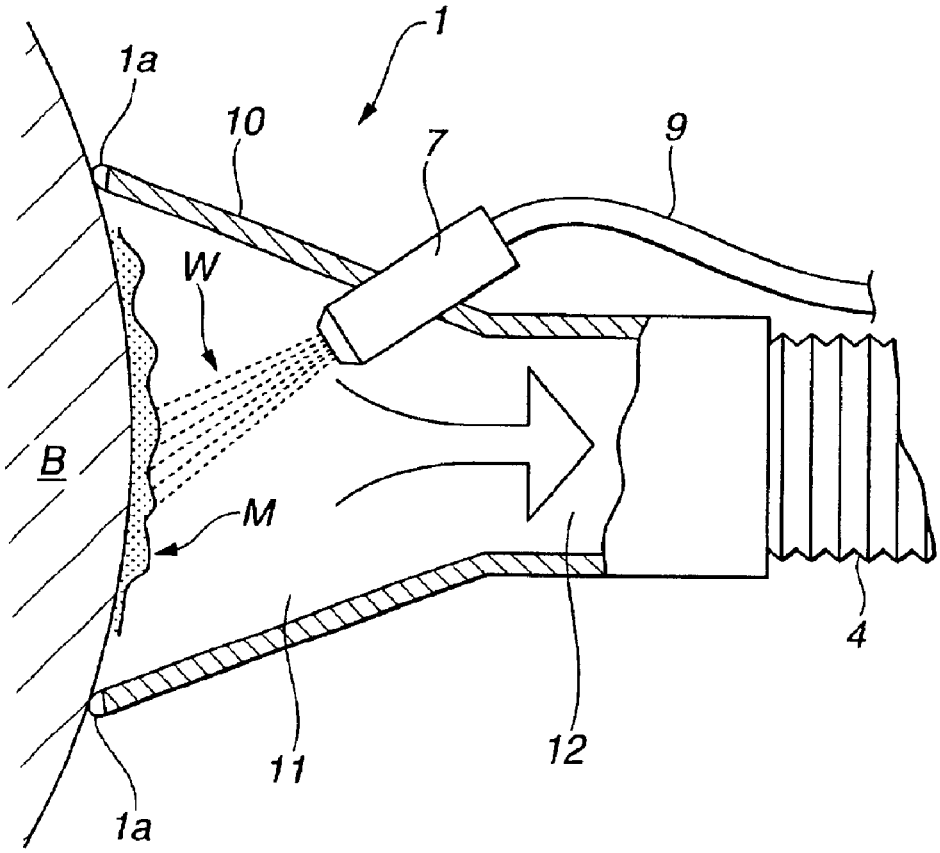
FIG. 3 is a sectional view of a part of the aspirator according to Embodiment 1 of this invention, in a state where an aspiration object is aspirated and removed.

FIG. 1 is a schematic view of the structure of an aspirator according to Embodiment 1 of this invention. FIG. 2 is a perspective view of a nozzle part of the aspirator shown in FIG. 1. FIG. 3 is a sectional view of a part of the aspirator in a state where an aspiration object is aspirated and removed.

Embodiment 1 will be described in the case where residual excrements (hereinafter referred to as the "aspiration object") on a person such as an elderly person who needs care are aspirated and removed, that is, in the case where it is assumed that there are residual excrements as the aspiration object on the human body. Needless to say, the aspirator of this invention can be used for various purposes other than the aspiration and removal of residual excrements on the human body.

The aspirator according to Embodiment 1 comprises, as main components, a nozzle 1, an aspirating device 2, an aspiration object tank 3 for storing the aspiration object aspirated through the nozzle 1 by the operation of the aspirating device 2, an accordion hose 4 for making the aspiration object tank 3 communicate with the nozzle 1, and a liquid supply device 5 for supplying liquid to a liquid injection device 7 of the nozzle 1.

As can be seen in FIG. 2 where a part of the nozzle 1 is cut away, the nozzle 1 comprises an opening 11 which can be opposed to a surface (human body) with the residual aspiration object, a cup-shaped nozzle body 10 having a suction port 12 for aspirating the aspiration object, and a liquid injection device 7, which is provided within the nozzle body 10, for ejecting liquid toward the aspiration object. The aspiration object is aspirated through this nozzle 1.

An end face of the opening 11, which contacts the human body and is opposed to the human body with the residual aspiration object, is covered with a pad la in order not to hurt the human body. The nozzle 1 is composed of transparent materials such as resins in order to make the inside of the nozzle 1 visible and to improve the working efficiency.

A specific example of the aspirating device 2 is a fan motor, which is set above the aspiration object tank 3.

The aspiration object tank 3 stores the aspiration object aspirated through the nozzle 1 by the action of the aspirating device 2. Accordingly, a suction force of the aspirating device 2 acts through the space in the aspiration object tank 3. However, in Embodiment 1, the aspiration object tank 3 is filled with water and the aspirated aspiration object is mixed with the water.

A gas-liquid separating mechanism (not shown in the drawing) which utilizes a driving force (or torque) of the aspirating device 2 intervenes between the aspirating device 2 and the aspiration object tank 3. Accordingly, needless to say, only air is exhausted from the aspirating device 2. Any detailed description is hereafter omitted about the gas-liquid separating mechanism and also about an aspirating system structural device (which by itself is generally called a "wet-and-dry cleaner") which uses the aspiration object tank filled with water because they are already known as described in Japanese Patent Laid-Open (Kokai) Publication No. HEI 10-304993.

The liquid supply device 5 comprises, as main components, a liquid tank 13 for storing liquid, a heating device 6 for heating the liquid stored in the liquid tank 13 to a given temperature, a liquid pumping device 8 for pumping the liquid stored in the liquid tank 13 to the liquid injection device 7, and a liquid passage tube 9 for making the liquid pumping device 8 communicate with the liquid injection device 7.

The aspirating device 2, the aspiration object tank 3, the liquid tank 13, the heating device 6, and the liquid pumping device 8 are contained in a case 14 with wheels for movement. Although specific details are not shown in the drawing, the case 14 is separable into two parts, top and bottom, so that contaminated water in the aspiration object tank 3 can be replaced.

Specifically, the liquid tank 13 is provided with a detachable cover 5*a* for refilling the liquid tank 13 with liquid. The heating device 6 exists under the liquid tank 13 and serves to heat the liquid (water) stored in the liquid tank 13 to a given liquid temperature (for example, from 30° C. to 35° C.). Moreover, the liquid pumping device 8 connected to the liquid tank 13 and the liquid passage tube 9 is specifically a motor-driven pump and pumps the liquid stored in the liquid tank 13 toward the liquid injection device 7. The liquid passage tube 9 for running the liquid is bound (or tied) to the hose 4 at given intervals so that it can move together with the hose 4.

On the other hand, the liquid injection device 7 serves to spray the liquid supplied from the liquid pumping device 8 on the aspiration object (residual excrements in a solidified state on the human body) before aspiration through the nozzle 1. Specifically, as shown in FIG. 2, the liquid injection device 7 is mounted at the nozzle body 10 in such a state that it protrudes toward the inside of the nozzle 1 in order to be opposed to the opening 11 (open face) of the nozzle 1. In other words, the liquid injection device 7 is fixed in a slanting manner so that the spraying liquid will pass through a virtual center 0 (as shown in FIG. 2) of the opening 11 of the nozzle body 10.

At the nozzle body 10 where the liquid injection device 7 is mounted, there is a portion with a uniform diameter on the side where the hose 4 is connected. At this portion, two switches (not shown in the drawing) are placed for operating or stopping the aspirating device 2 and the liquid pumping device 8. Accordingly, between the nozzle 1 and the case 14, there is in fact a cable for transmitting electric signals in addition to the hose 4 and the liquid passage tube 9.

In Embodiment 1, water (warm water) is used as the liquid to spray on the aspiration object, but other kinds of liquid may be substituted for such water.

Generally speaking, as shown in FIG. 3, the aspirator according to Embodiment 1 can spray a liquid W from the liquid injection device 7 toward an aspiration object M (residual solidified excrements on the human body B). Together with the sprayed liquid W, the aspiration object M which has come off the attached position is aspirated through the nozzle 1 by the action of the aspirating device 2. Subsequently, the aspiration object M and the liquid W which are aspirated in this manner are then stored in the aspiration object tank 3.

As described above, in addition to the aspirating system structural device composed of, for example, the nozzle 1, the aspirating device 2, and the aspiration object tank 3, the aspirator according to Embodiment 1 includes a liquid spraying system structural device (or liquid spraying device) for spraying the liquid W on the aspiration object M, more particularly the liquid spraying system structural device composed of the liquid tank 13, the liquid injection device 7, the liquid pumping device 8, and the liquid passage tube 9. The aspirator is structured in such a manner that the aspiration object M together with the liquid W sprayed on the aspiration object M is aspirated through the nozzle 1 by the action of the aspirating device 2 and is then stored in the aspiration object tank 3. Accordingly, even if the aspiration object M to be aspirated and removed has already solidified, it is possible to deal with such a situation easily. Specifically speaking, the residual solidified aspiration object M softens by the action of the liquid W sprayed thereon and quickly comes off the attached position. Moreover, the detachment of the aspiration object M is promoted by the impetus of the liquid W. As a result, it is possible to aspirate and remove the residual aspiration object M, which has solidified on the human body, easily and efficiently.

The aspirator explained with regard to Embodiment 1 is merely one example, and it is without saying that the aspirator of this invention is not limited to the above-described structure.

This aspirator enables easy removal of the residual solidified object (aspiration object). More particularly, it is possible to easily and efficiently aspirate and remove the residual solidified object (aspiration object) on the human body.

The nozzle 1 may either be fixed at the hose 4 or be in a detachable (attachable and detachable) form.

(Embodiment 2)

An explanation is hereinafter given about a nozzle according to Embodiment 2 of this invention by referring to the relevant drawings. The nozzle according to Embodiment 2 is connected to an aspirator and is used to aspirate the aspiration object. Embodiment 2 explains about a case where the nozzle is connected to the aspirator according to Embodiment 1.

Figure 4:
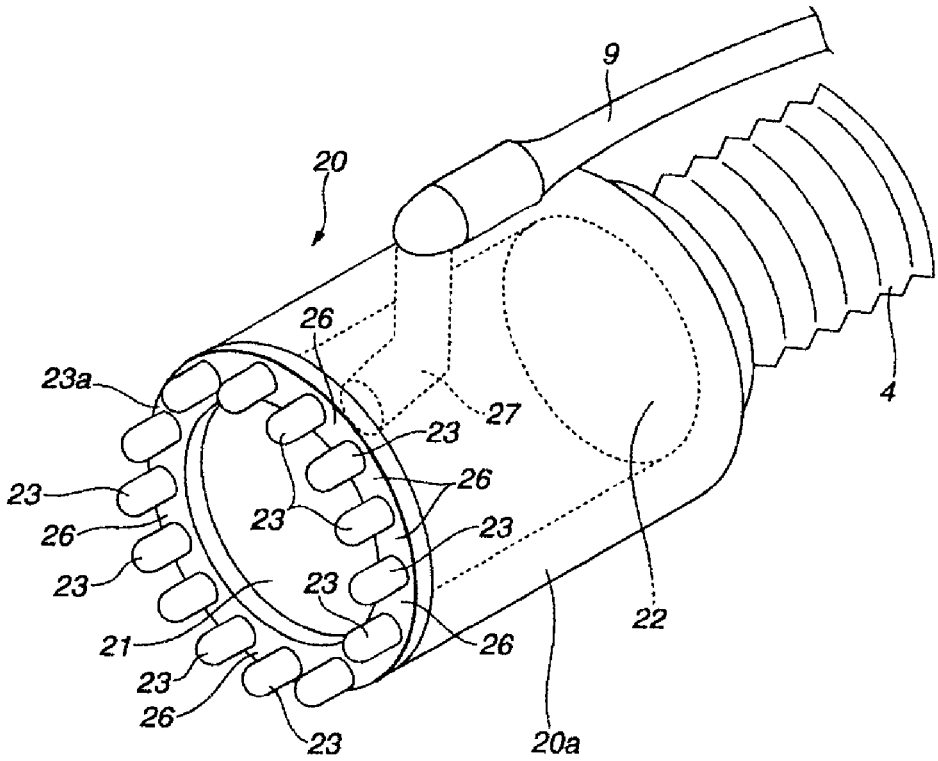
FIG. 4 is a perspective view of a nozzle according to Embodiment 2 of this invention.
Figure 5:
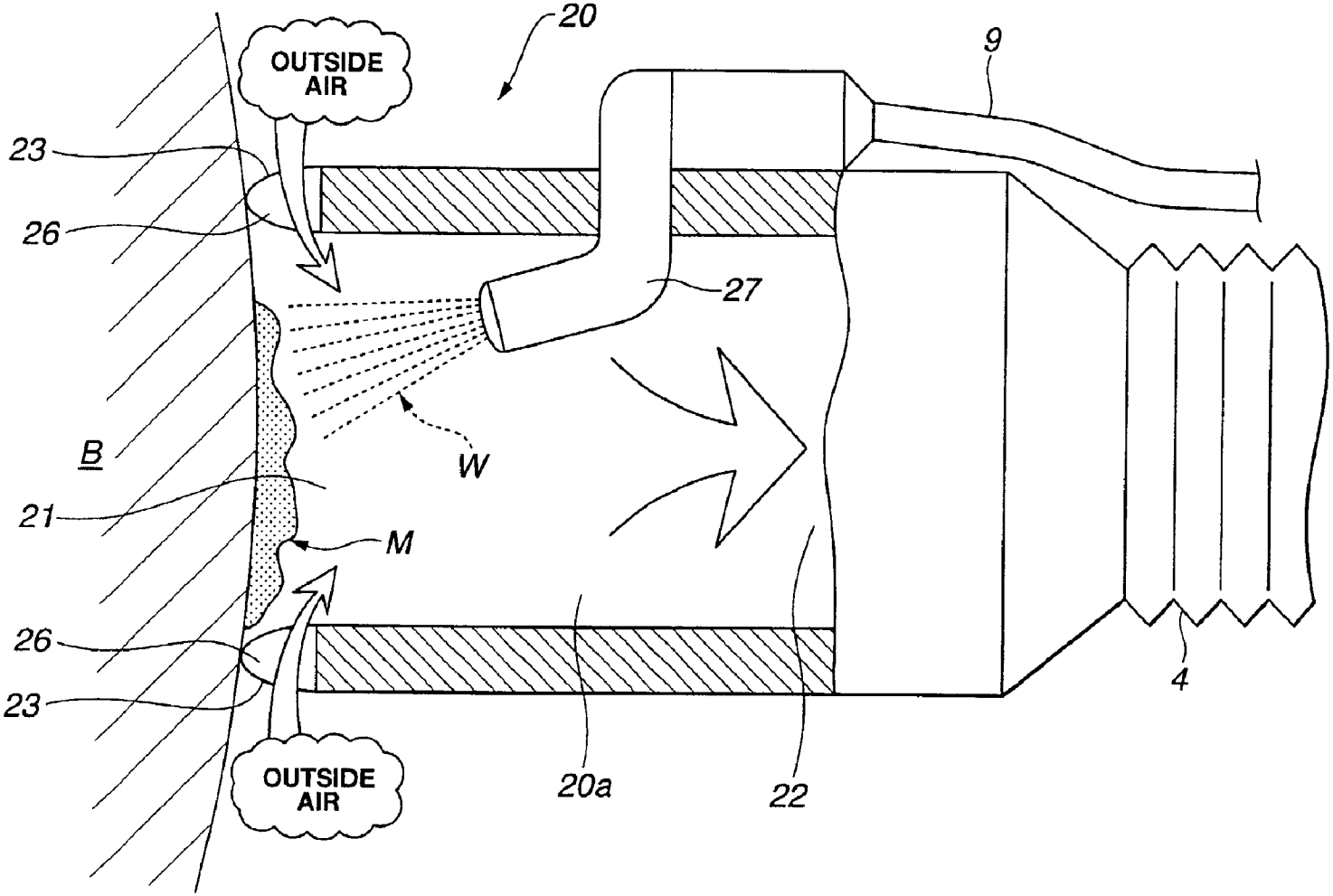
FIG. 5 is a sectional view illustrative of the working of the nozzle according to Embodiment 2 of this invention.

FIG. 4 is a perspective view of a nozzle according to Embodiment 2, and FIG. 5 is a sectional view illustrative of the working of the nozzle according to Embodiment 2.

Elements of Embodiment 2 similar to those of Embodiment 1 are given the same reference numerals as in Embodiment 1 and any detailed description thereof is omitted.

As shown in FIGS. 4 and 5, a nozzle 20 according to Embodiment 2 comprises an opening 21 which can be opposed to a surface (human body) with a residual aspiration object, a substantially cylindrical nozzle body 20*a* having a suction port 22 for aspirating the aspiration object, and a liquid injection device 27, which is provided within the nozzle body 20*a*, for ejecting liquid toward the aspiration object. The aspiration object is aspirated through this nozzle 20.

A hose 4 of an aspirator is connected to the suction port 22. On an end face of the opening 21, which is opposed to the human body with the residual aspiration object, a plurality of outside-air inlets 26 are formed for introducing ambient outside air into the nozzle body 20*a* when the aspirator is operated. These outside-air inlets 26 are composed of spaces between a plurality of projections 23 formed in a peripheral direction of the end face of the opening 21.

Since these projections 23 directly contacts the human body, they are made of, for example, soft materials such as rubber in order not to hurt the skin. Moreover, the top ends of the projections 23 are rounded.

Embodiment 2 employs the structure where a plurality of projections 23 are mounted integrally on a ring-shaped base 23, that is, the structure where the projections 23 are composed as a member separate from the nozzle body 20*a*. However, without limitation to the above-described structure, the projections 23 may be composed integrally with the nozzle body 20*a*.

The liquid injection device 27 is set within the nozzle body 20*a* and serves to spray the liquid supplied from a liquid pumping device 8 toward the aspiration object (residual excrements in a solidified state on the human body) before aspiration through the nozzle 20 into the aspiration object tank 3. Specifically, as shown in FIG. 5, the liquid injection device 27 is mounted at the nozzle body 20*a* in such a manner that the liquid injection device 27 protrudes toward the inside of the nozzle body 20*a* and in a slanting state in order to be opposed to the opening 21 (open face) of the nozzle 20. Accordingly, the liquid injection device 27 can eject the liquid in a slightly slanting direction relative to the surface of the human body.

In Embodiment 2, a tube substantially in a shape of the letter L is used as the liquid injection device 27 and a major part of the liquid injection device 27 is placed in the inside space of the nozzle body 20*a*. The base end side of the liquid injection device 27 is connected with a liquid passage tube 9 extending from the aspirator.

The working of the nozzle 20 according to Embodiment 2 is hereinafter explained with reference to FIG. 5.

FIG. 5 illustrates the state where the aspirator is operated to spray a liquid W on an aspiration object M (residual excrements on the human body B). As can be seen from the drawing, during the aspiration of the aspiration object M, the outside air is introduced (or aspirated) into the nozzle body 20*a* through the outside-air inlets 26 (spaces between the projections 23) formed on the end face of the opening 21 of the nozzle body 20*a*. Accordingly, the inside of the nozzle body 20*a* will not be depressurized significantly due to the aspirating action of the aspirator. As a result, the nozzle 20 adsorbs with reasonable force to the surface of the human body B with the residual aspiration object M. Therefore, when the nozzle having the structure of Embodiment 2 is used, it is possible to conduct the operation more easily to move the nozzle 20 over the surface of the human body B with the residual aspiration object M.

Moreover, as described above, the outside air is introduced (or aspirated) with substantial force into the nozzle body 20*a* through the outside-air inlets 26 during the aspiration. In other words, a strong inward flow of the outside air is formed at the outside-air inlets 26. Accordingly, when the liquid W is sprayed on the aspiration object M within the nozzle body 20*a*, the liquid W hits the surface of the human body B and disperses, and is then immediately pushed back by the flow of outside air. Consequently, the liquid W will not disperse out of the nozzle 20 through the outside-air inlets 26. Therefore, it is possible to conduct the work in a good environment without soiling the surroundings.

As described above, the aspiration object M is aspirated through the nozzle 20 by the action of the aspirating device 2 and is then stored in the aspiration object tank 3. Therefore, even if the aspiration object M to be aspirated and removed has already solidified, it is possible to deal with such a situation easily. Specifically speaking, the residual aspiration object M which has solidified softens by the action of the liquid W sprayed thereon and quickly comes off the attached position. Moreover, the detachment of the aspiration object M is promoted by the impetus of the liquid W. As a result, it is possible to easily and efficiently aspirate and remove the solidified residual aspiration object on the human body.

Figure 6:
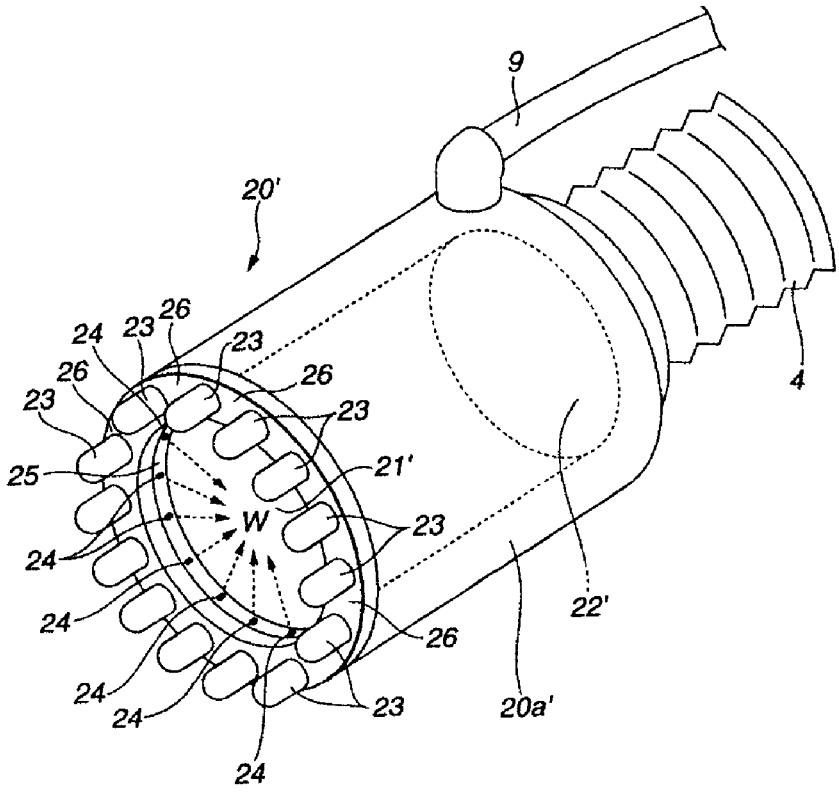
FIG. 6 is a perspective view of a variation example of the nozzle according to Embodiment 2 of this invention.

A variation example of the nozzle 20 according to Embodiment 2 is hereinafter explained with reference to the relevant drawing. FIG. 6 is a perspective view of the variation example of the nozzle according to Embodiment 2.

As for this variation example, its basic technical concept and basic structure are the same as those of the embodiment described above. Accordingly, the following description is mainly focused on differences from the above-described embodiment.

The nozzle 20' of FIG. 6 is characterized in that liquid injection holes 24 for ejecting liquid to spray on an aspiration object are formed directly in a nozzle body 20*a*'. Specifically speaking, a plurality of liquid injection holes 24 are formed at given intervals at a place which is an inner surface of an opening 21' of the nozzle body 20' and which is an end face 25 opposed to the aspiration object.

These liquid injection holes 24 exist on the inner side of projections 23 which form outside-air inlets 26 as spaces between the adjacent projections 23. (According to the circumstances, the liquid injection holes 24 may exist in areas between the projections 23.) Moreover, in this embodiment, the liquid injection holes 24 are formed on the end face 25 at substantially fixed intervals in a peripheral direction.

Although it is not particularly shown in FIG. 6, liquid guide passages corresponding to the liquid injection holes 24 exist inside of the inner wall of the nozzle body 20*a'*. These liquid guide passages are unified on the base end side of the nozzle body 20*a'*, where a liquid passage tube 9 extending from the aspirator is connected. The nozzle 20' having this structure has a liquid injection device composed of the liquid injection holes 24 and the liquid guide passages not shown in the drawing. It is also possible to provide the liquid injection device structured in such a manner that the liquid guide passages and the liquid injection holes 24 are combined.

The nozzle 20' structured in the above-describe manner is particularly preferred for the aspiration and removal of the residual aspiration object (such as excrements) around a protrusion (such as male genital organs). Specifically speaking, the aspiration and removal of the aspiration object can be conducted by spraying the liquid (shown with the letter W in FIG. 6) directly over and in a direction perpendicular to the surface around the protrusion while the protrusion is placed within the nozzle body 20*a'* and, therefore, such a nozzle exhibits highly excellent working efficiency. When the structure of this embodiment is adopted, the inside diameter and the depth of the nozzle body 20*a'* are appropriately enlarged or reduced in order to fit the size of the protrusion.

When the nozzle having the above-described structure is attached to the aspirator, it is possible to easily move the nozzle, during the aspiration, over the surface with the residual aspiration object. Moreover, even if the liquid is sprayed on the aspiration object within the nozzle, the liquid will not disperse out of the nozzle.

(Embodiment 3)

An explanation is hereinafter given about a nozzle according to Embodiment 3 of this invention by referring to the relevant drawings. Just like the nozzle according to Embodiment 2, the nozzle according to Embodiment 3 is also connected to an aspirator and is used to aspirate an aspiration object. Embodiment 3 also explains about the case where the nozzle is connected with the aspirator of Embodiment 1.

Figure 7:
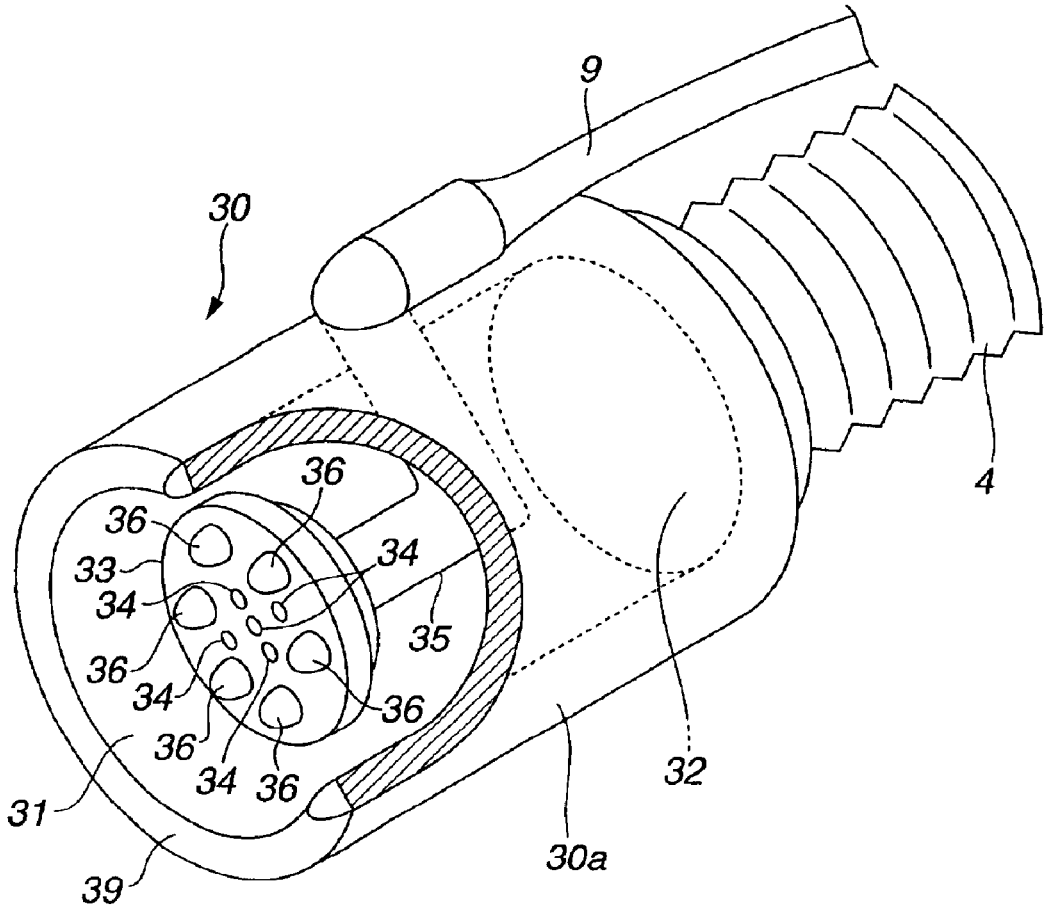
FIG. 7 is a perspective view of a nozzle according to Embodiment 3 of this invention in a state partially cut away.
Figure 8:
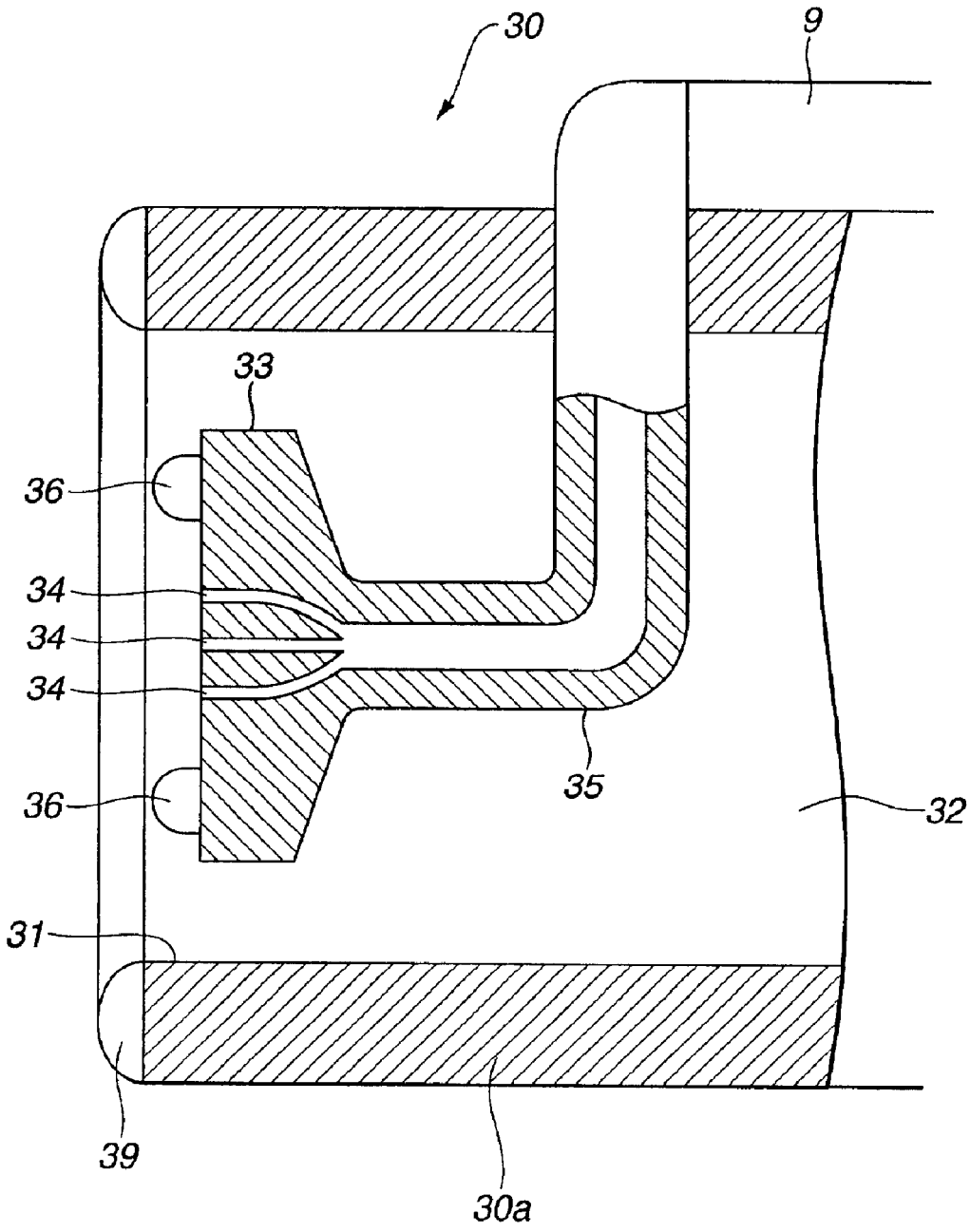
FIG. 8 is an enlarged sectional view of a principal portion of the nozzle shown in FIG. 7.
Figure 9:
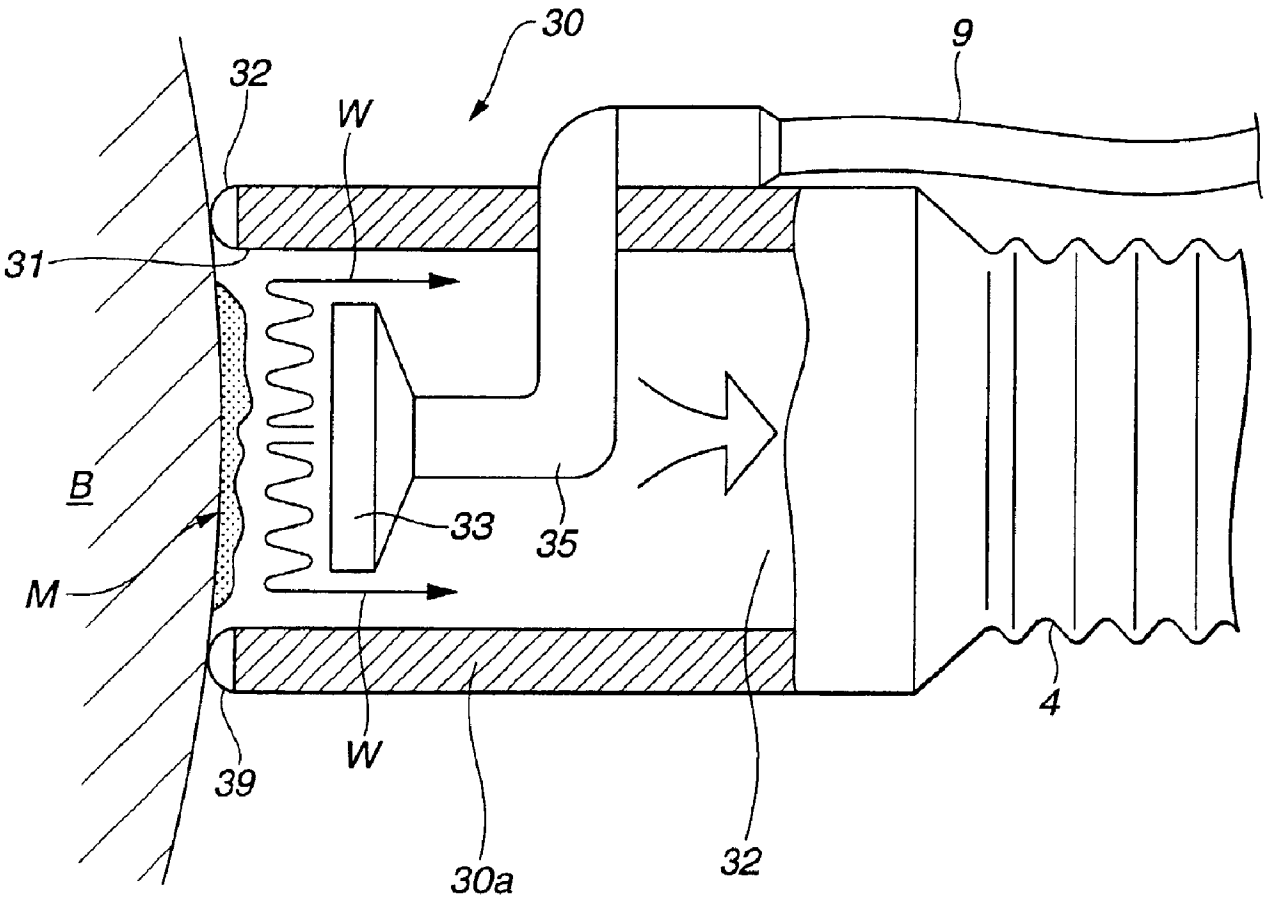
FIG. 9 is a sectional view illustrative of the working of the nozzle according to Embodiment 3 of this invention.

FIG. 7 is a perspective view of the nozzle according to Embodiment 3 in a state partially cut away. FIG. 8 is an enlarged sectional view of a principal portion of the nozzle shown in FIG. 7. FIG. 9 is a sectional view illustrative of the working of the nozzle according to Embodiment 3.

Elements of Embodiment 3 similar to those of Embodiments 1 and 2 are given the same reference numerals as in Embodiments 1 and 2 and any detailed description thereof is omitted.

As shown in FIGS. 7 through 9, a nozzle 30 according to Embodiment 3 comprises an opening 31 which can be opposed to a surface (human body) with a residual aspiration object, a substantially cylindrical nozzle body 30*a* having a suction port 32 for aspirating the aspiration object, and a liquid injection device 37, which is provided within the nozzle body 30*a*, for ejecting liquid toward the aspiration object. The aspiration object is aspirated through this nozzle 30.

A hose 4 of the aspirator is connected to the suction port 32. An end face of the opening 31, which is opposed to the human body with the residual aspiration object, is covered with a soft pad 39 in order not to hurt the skin of a person who needs care during the aspiration work.

At a position recessed from the opening 31 of the nozzle body 30*a*, that is, the position closer to the side of the hose 4, a barrier plate 33 is provided in such a manner that the barrier plate 33 is placed substantially in parallel with (or may be placed slightly slantingly relative to) an open face of the opening 31 and the center of the barrier plate 33 coincides with the center of the opening 31. This barrier plate 33 is composed in a circular shape in order to fit the sectional shape of the nozzle body 30*a*. Moreover, the surface area of the barrier plate 33 is smaller than the sectional area of a cavity of the nozzle body 30*a* at the position where the barrier plate 33 is provided. In other words, the diameter of the barrier plate 33 is set at a value smaller than the inside diameter of the nozzle body 30*a*. This is because the air flow toward the hose 4 side should not be blocked by the barrier plate 33.

In an approximate center area of the barrier plate 33, a plurality of liquid injection holes 34 are formed for ejecting liquid (such as warm water) to spray on the aspiration object. As can be seen in FIG. 8, the barrier plate 33 is supported within the nozzle body 30*a* by a hollow stay 35 substantially in a shape of the letter L, which is mounted on the inner surface of the nozzle body 30*a* (in fact, the base end side of the stay 35 is engaged with the inner surface of the nozzle body 30*a*). This stay 35 is connected with a liquid passage tube 9. In Embodiment 3, the nozzle is structured in such a manner that the liquid to spray on the aforementioned aspiration object is supplied through the inside of the stay 35 to the liquid injection holes 34 in the barrier plate 33. Accordingly, regarding the nozzle 30, the barrier plate 33 and the stay 35 compose a liquid injection device.

In Embodiment 3, the barrier plate 33 and the stay 35 are structured integrally, but they may be composed as separate members.

On the surface of the barrier plate 33, which is opposed to the aspiration object, a plurality of projections 36 are formed. These projections 36 are formed on the edge side of the barrier plate 33 where the liquid injection holes 34 do not exist. Moreover, the top ends of the projections 36 are rounded. In Embodiment 3, these projections 36 are structured with such a height that the top ends of the projections 36 almost reach the open face of the opening 31. (More specifically, the projections 36 have such a height that their top ends exist at a position slightly recessed from the open face of the opening 31). As the projections 36 are provided, the liquid flowing toward the barrier plate 33 is further agitated during the aspiration, thereby further improving the efficiency of removal of the aspiration object.

An explanation is hereinafter given about the working of the nozzle 30 according to Embodiment 3 by referring to FIG. 9. In FIG. 9, the projections 36 are omitted to make the explanation easier to understand.

As shown in FIG. 9, the aspirator is operated to spray a liquid W on an aspiration object M (residual excrements on the human body B). As can be seen in FIG. 9, during the aspiration of the aspiration object M, the liquid W is sprayed from the liquid injection holes 34 in the barrier plate 33 toward the aspiration object M. After the liquid W hits the aspiration object M (the surface with the residual aspiration object), it splashes back toward the deep end of the nozzle body 30*a*. However, with the nozzle 3 according to Embodiment 3, as described above, the barrier plate 33 is provided at a position recessed from the open face of the opening 31 which is opposed to the aspiration object M. Therefore, the splashed liquid W splashes again back to the side of the aspiration object M because of the existence of the barrier plate 33. This action is then repeated with attenuation.

On the other hand, a strong air flow toward the deep end of the nozzle is formed within the nozzle body 30*a* because of the aspiration. Accordingly, the liquid W ejected from the liquid injection holes 34 flows radially toward the peripheral side of the barrier plate 33 as it splashes back and forth between the barrier plate 33 and the human body B with the residual aspiration object M. Consequently, when this nozzle 30 is used, it is possible to spray the liquid W toward (or to cause the liquid W to act on) the aspiration object M very efficiently as compared with a method of ejecting liquid toward a certain spot on the aspiration object M. Specifically, it is possible to spray the liquid W (or to cause the liquid W to work) with force in a wide range (with the same area as that of the barrier plate 33) at once. As a result, it is possible to realize a leap upward in the efficiency of the work to aspirate and remove the aspiration object M.

Figure 10:
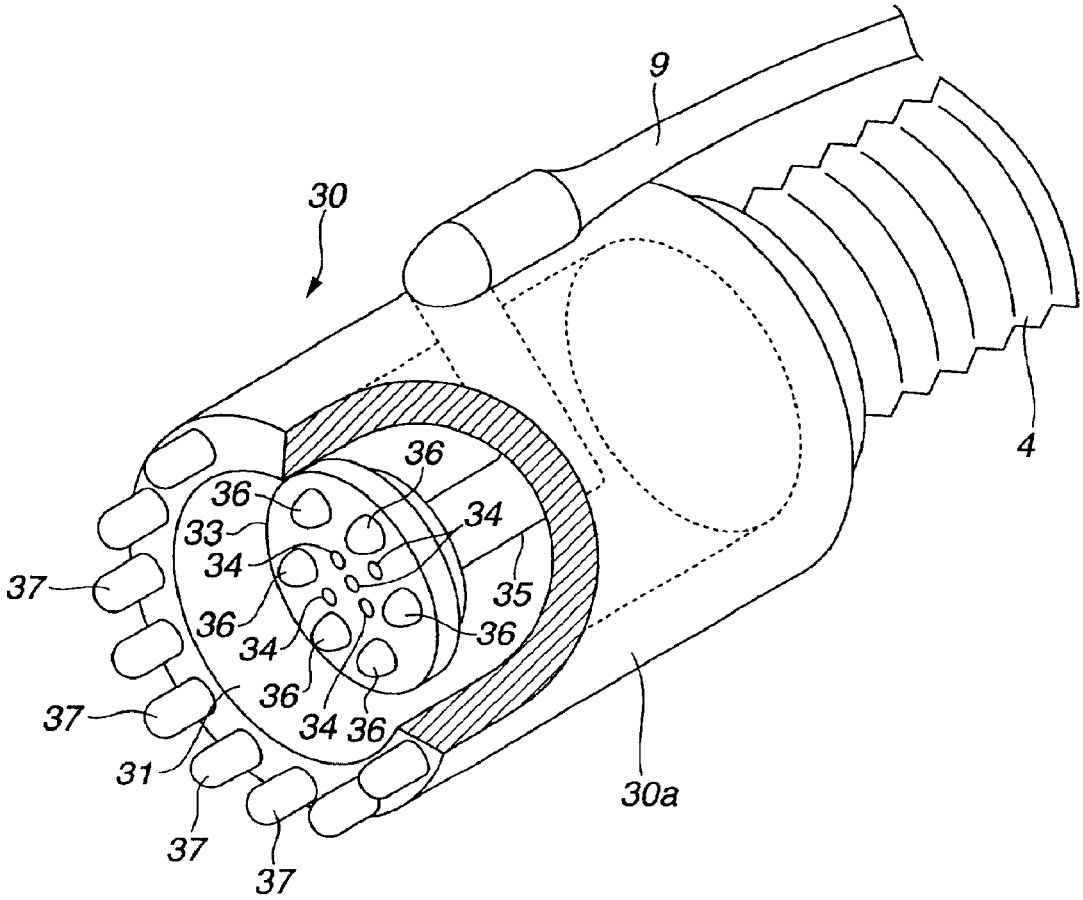
FIG. 10 is a perspective view of a variation example of the nozzle according to Embodiment 3 of this invention.

In Embodiment 3, the nozzle structured to have a flat open end face (an annular end face on the open side) of the opening 31 is used as an example. However, without limitation to such a structure, as shown in FIG. 10, a plurality of projections 37 of which top ends are made in a hemispherical shape may be formed in a peripheral direction of the end face of the opening 31, which is opposed to the human body with the residual aspiration object. Consequently, as explained in Embodiment 2, the inside of the nozzle body 30*a* will not be depressurized significantly by the aspirating action of the aspirator. Therefore, it is possible to conduct the operation more easily to move the nozzle 30, during the aspiration of the aspiration object, over the surface of the human body B with the residual aspiration object M.

The nozzle 30 according to Embodiment 3 makes it possible to spray the liquid (or cause the liquid to act) on the aspiration object efficiently. Specifically, it is possible to spray the liquid (or cause the liquid to work) with force in a wide range.

(Embodiment 4)

An explanation is hereinafter given about a nozzle according to Embodiment 4 of this invention by referring to the relevant drawings. Just like the nozzles according to Embodiments 2 and 3, the nozzle according to Embodiment 4 is also connected to an aspirator and is used to aspirate an aspiration object. Embodiment 4 also explains about the case where the nozzle is connected with the aspirator of Embodiment 1.

Figure 11:
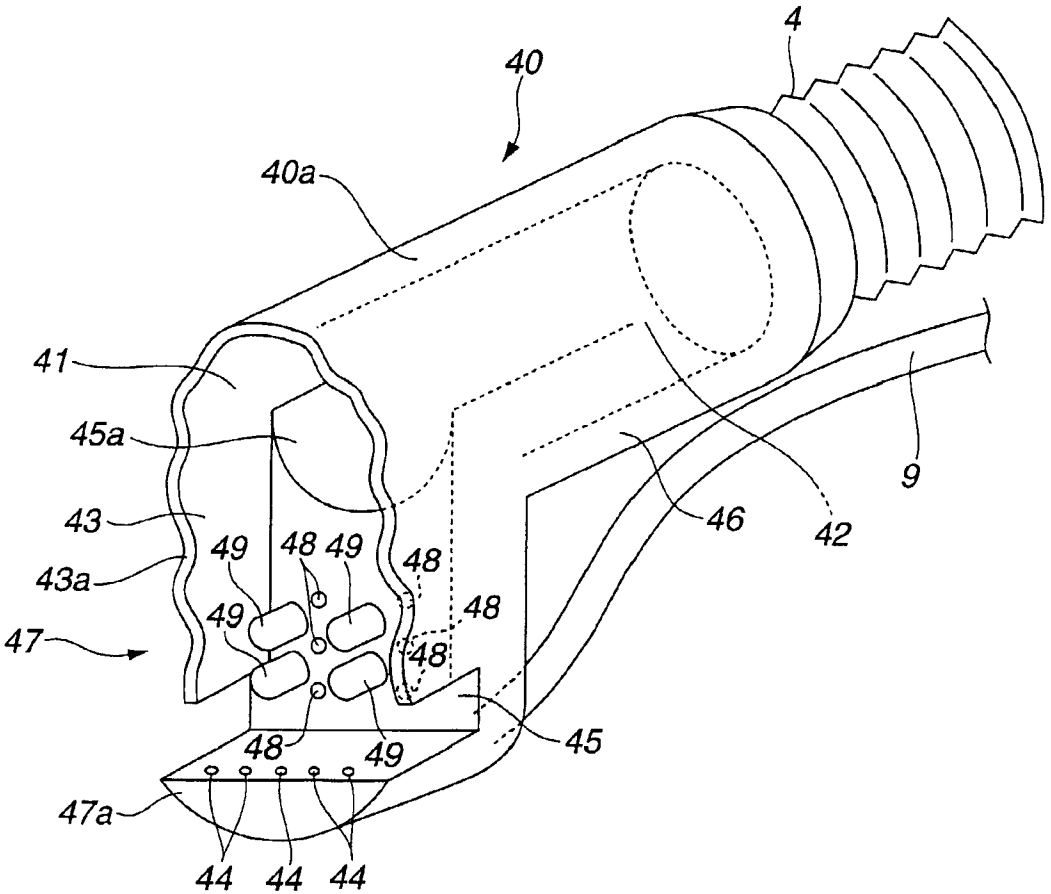
FIG. 11 is a perspective view of a nozzle according to Embodiment 4 of this invention.
Figure 12:
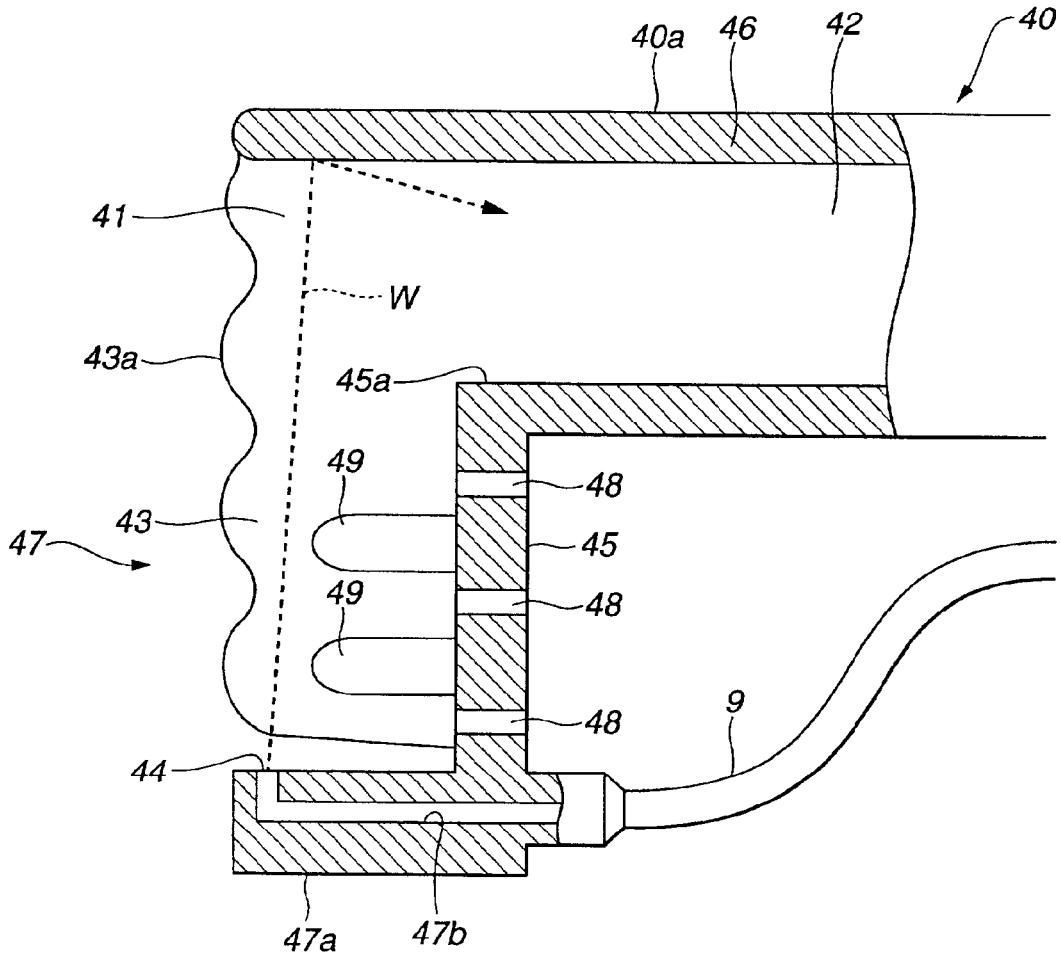
FIG. 12 is an enlarged sectional view of a principal portion of the nozzle shown in FIG. 11.
Figure 13:
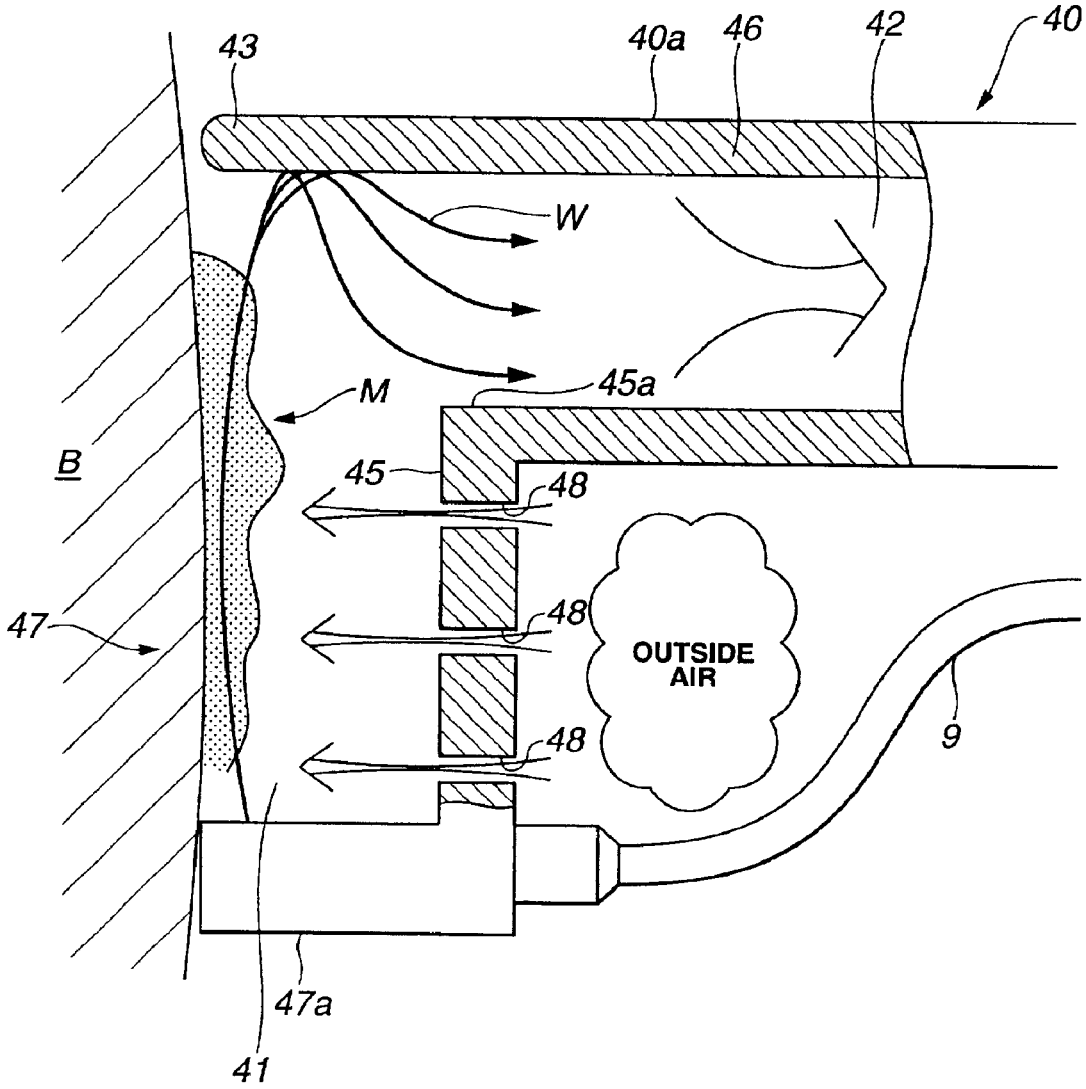
FIG. 13 is a sectional view illustrative of the working of the nozzle according to Embodiment 4 of this invention.

FIG. 11 is a perspective view of the nozzle according to Embodiment 4. FIG. 12 is an enlarged sectional view of a principal portion of the nozzle shown in FIG. 11. FIG. 13 is a sectional view illustrative of the working of the nozzle according to Embodiment 4.

Elements of Embodiment 4 similar to those of Embodiments 1 through 3 are given the same reference numerals as in Embodiments 1 through 3 and any detailed description thereof is omitted.

As can be seen in FIGS. 11 through 13, a nozzle 40 according to Embodiment 4 comprises: an opening 41 which can be opposed to a surface (human body) with a residual aspiration object; a nozzle body 40*a* shaped substantially in the letter L, which has a suction port 42 for aspirating the aspiration object; and a liquid injection device 47 which is provided at the nozzle body 40*a*. The aspiration object is aspirated through this nozzle 40.

The nozzle body 40*a* comprises a barrel member 46 in a cylindrical shape, having a suction port 42 connected with a hose 4 of the aspirator, and a face member 45 provided at the top end side of the barrel member 46.

The liquid injection device 47 comprises a barrier member 43 having a substantially U-shaped section, which continuously extends from the barrel member 46 of the nozzle body 40*a*, and a liquid injection device body 47*a* which is provided at the nozzle body 40*a* at the position opposed to the bend portion of the barrier member 43. On the end face of the barrier member 43, which is opposed to the human body with the residual aspiration object, undulant irregularities are continuously formed. (As a matter of course, this end face may be flat.)

A plurality of liquid injection holes 44 are formed in a surface of the liquid injection device body 47*a*, which is opposed to the bend portion of the barrier member 43. In other words, the nozzle is structured in such a manner that the liquid (such as warm water) ejected from the liquid injection holes 44 collides with the bend portion of the barrier member 43 and is then aspirated through the suction port 42.

Describing the nozzle 40 according to Embodiment 4 in more detail, the barrier member 43 is composed integrally with the nozzle body 40*a*, as described above, at the position opposed to the liquid injection holes 44. More particularly, the barrier member 43 (or, to be precise, its center portion) is mounted at the nozzle body 40*a* at the position opposed to the liquid injection holes 44 by surrounding the suction port 42 (or a circular hole 45*a* which will be described later) (along the periphery of the face member 45) so that the liquid ejected from the liquid injection holes 44 will directly collide with the barrier member 43.

In Embodiment 4, the barrier member 43 is shaped substantially in the letter U to surround the suction port 42 of the nozzle body 40*a* and is structured in such a manner that the liquid ejected from the liquid injection holes 44 will collide with the center portion (or bend portion) of the substantially U-shaped barrier member 43. In addition, the undulant irregularities 43*a* formed on the end face of the barrier member 43, which is opposed to the human body with the residual aspiration object, allow the outside air to be actively introduced into the nozzle body 40*a* during the aspiration. Moreover, the height of the barrier member (a distance from the surface of the face member 45 to the highest point of the barrier member 43) is made uniform. However, the height of the barrier member 43 may not be uniform. For example, it is possible to structure the barrier member 43 in such a manner that the height of the barrier member 43 becomes lower toward the side of the liquid injection device 47.

In the face member 45, there is the circular hole 45*a* having the diameter equal to the inside diameter of the barrel member 44. This circular hole 45*a* communicates with the inside space of the barrel member 44 and defines the suction port 42 which leads to the aspirator.

Moreover, a plurality of perforating holes 48 are made in the face member 45. Specifically, these perforating holes 48 exist in an area of the face member 45, which is opposed to the surface with the residual aspiration object, between the circular hole 45*a* (or the suction port 42) and the liquid injection holes 44. Accordingly, when the aspirator is operated, the outside air is introduced through the perforating holes 48 into the nozzle body 40*a* (into the space between the surface with the residual aspiration object and the face member 45). As will be described later in more detail, the outside air introduced (or blowing) through the perforating holes 48 serves to forcibly push the liquid ejected from the liquid injection holes 44 toward the side of the aspiration object to be aspirated and removed.

Furthermore, a plurality of projections 49 are formed on the face member 45 (on the side opposed to the surface with the residual aspiration object) at positions where there are no perforating holes 48. The projections 49 may be formed either as a separate member from the member composing the nozzle body 40*a* or integrally with the member composing the nozzle body 40*a*. Specifically, these projections 49 exist at positions where the liquid ejected from the liquid injection holes 44 will not contact the projections 49, and the top ends of the projections 49 are rounded. Moreover, the height of the projections 49 is set at a value shorter than the distance from the surface of the face member 45 to the liquid injection holes 44.

As can be specifically seen in FIG. 12, the liquid injection holes 44 made in the liquid injection device body 47*a* are provided in such a manner that the liquid (shown with the letter W in FIG. 12) will be ejected in a direction substantially in parallel with the face member 45. More specifically, the liquid injection holes 44 are formed in such a manner that when the nozzle body 40*a* (particularly the face member 45 thereof) is opposed to the surface with the residual aspiration object, the liquid to be sprayed on the aspiration object is ejected in a direction substantially in parallel with the surface with the residual aspiration object.

Within the liquid injection device body 47*a*, liquid guide passages 47*b* are formed corresponding to the individual liquid injection holes 44. These liquid guide passages 47*b* are unified on the aspirator side (on the upstream side), where a liquid passage tube 9 extending from the aspirator is connected.

FIG. 12 illustrates the state where the aspirator is not operated, that is, the suction force is not working. Specifically speaking, the nozzle is structured in such a manner that the liquid ejected from the liquid injection holes 44 hits the surface of the barrier member 43 actually not in a perpendicular direction, but in a slightly slanting direction (relative to a vertical line extending from the surface of the barrier member 43). The nozzle is structured in the above-described manner in order to prevent the liquid which has collided with the barrier member 43 from dispersing out of the nozzle. In other words, it is intended to cause the liquid which has collided with the barrier member 43 to splash back into the barrel member 46 of the nozzle body 40*a*. Alternatively, the barrier member 43 (particularly its center portion) may be structured to be slanting relative to the side of the liquid injection holes 44. If such a structure is employed, it is possible to eject the liquid straight from the liquid injection holes 44.

An explanation is hereinafter given about the working of the nozzle 40 according to Embodiment 4 by referring to FIG. 13. In FIG. 13, the projections 49 are omitted to make the explanation easier to understand.

As shown in FIG. 13, the aspirator is operated to spray a liquid W on an aspiration object M (solidified residual excrements on the human body B). As can be seen in FIG. 13, when the nozzle 40 according to Embodiment 4 is used, a flow of the liquid W is reversed within the nozzle body 40*a* during the aspiration of the aspiration object M. In other words, since the liquid W circulates without dispersing out of the nozzle, the liquid W will never disperse even if the nozzle is moved away by mistake from the surface with the residual aspiration object M while the liquid W is being ejected. Accordingly, it is possible to conduct the task in a good environment without soiling the surroundings.

Moreover, when the nozzle 40 according to Embodiment 4 is used, the liquid W is sprayed on the aspiration object M to be aspirated and removed over the surface with the residual aspiration object M. Therefore, it is possible to spray the liquid W (or to cause the liquid W to act) on the aspiration object M in a short time more efficiently, as compared with a method of ejecting the liquid W down to a certain spot on the opposed surface with the residual aspiration object.

Moreover, with the nozzle 40, the perforating holes 48 are formed in the face member 45 of the nozzle body 40*a*, and through the perforating holes 48, the outside air is introduced into the space between the surface with the residual aspiration object M and the face member 45. Accordingly, the liquid W ejected from the liquid injection holes 44 is forcibly pushed toward the side of the aspiration object M by the pressure of the outside air introduced (or blowing) through the perforating holes 48. Namely, the path of the liquid W is bent with a convex curve toward the side of the aspiration object M. As a result, the ejected liquid W washes down the aspiration object M with more certainty. In other words, the liquid W acts on the aspiration object M more effectively, thereby exhibiting highly excellent aspiration and removal performance.

Embodiment 4 employs the structure where several streams of the liquid W are sprayed on the aspiration object M. However, an alternative structure may be adopted where the liquid W is ejected in a fan shape from one liquid injection hole.

If this nozzle 40 is used, the liquid will not disperse around during the aspiration even if the nozzle 40 is moved away from the surface with the residual aspiration object while the liquid is being ejected. Specifically, even if the nozzle 40 is moved away from the surface with the residual aspiration object during the aspiration while the liquid is being ejected, the liquid will not disperse around. In addition, it is possible to spray the liquid (or cause the liquid to act) on the aspiration object efficiently.

(Embodiment 5)

An explanation is hereinafter given about a nozzle according to Embodiment 5 of this invention by referring to the relevant drawings. Just like the nozzles according to Embodiments 2 and 4, the nozzle according to Embodiment 5 is also connected to an aspirator and is used to aspirate an aspiration object. Embodiment 5 is also explained about the case where the nozzle is connected with the aspirator of Embodiment 1.

Figure 14:
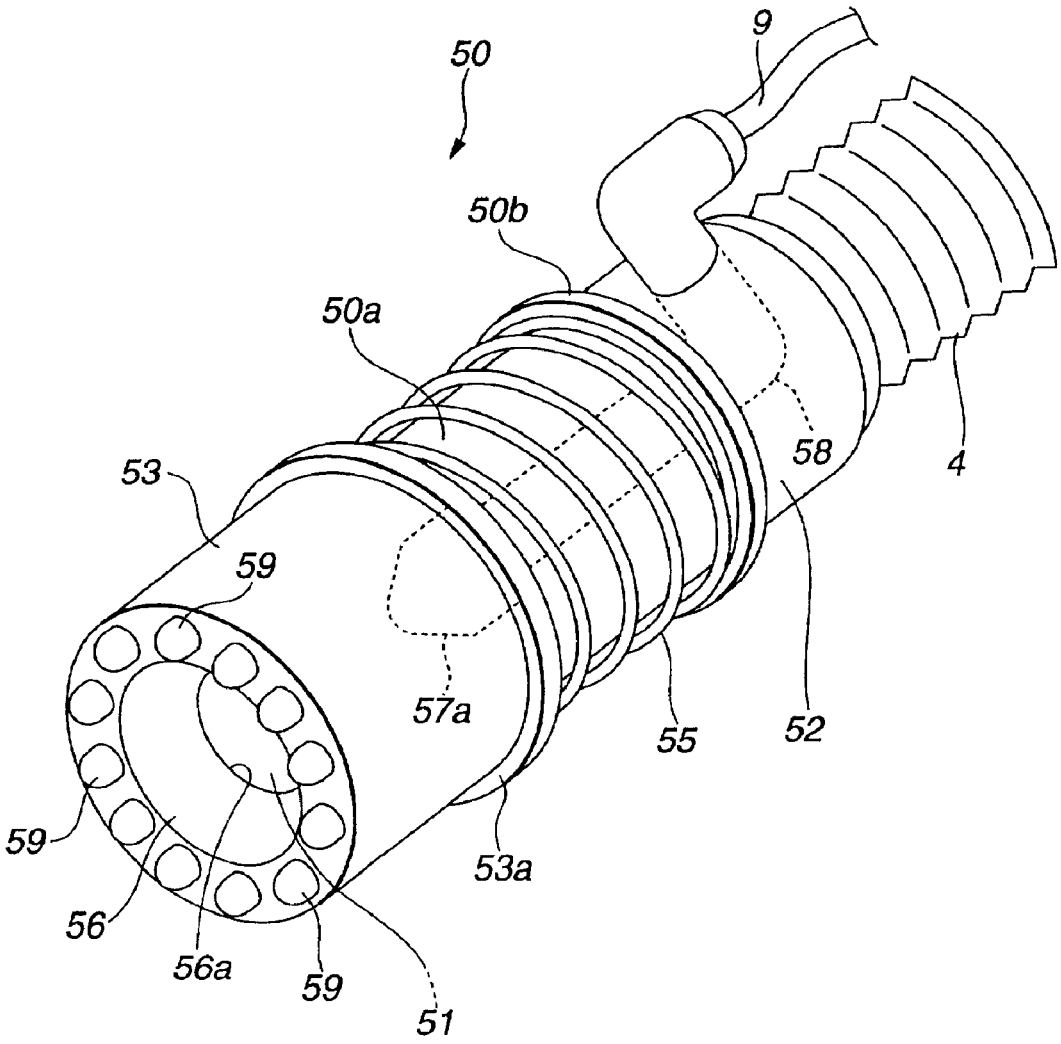
FIG. 14 is a perspective view of a nozzle according to Embodiment 5 of this invention.
Figure 15:
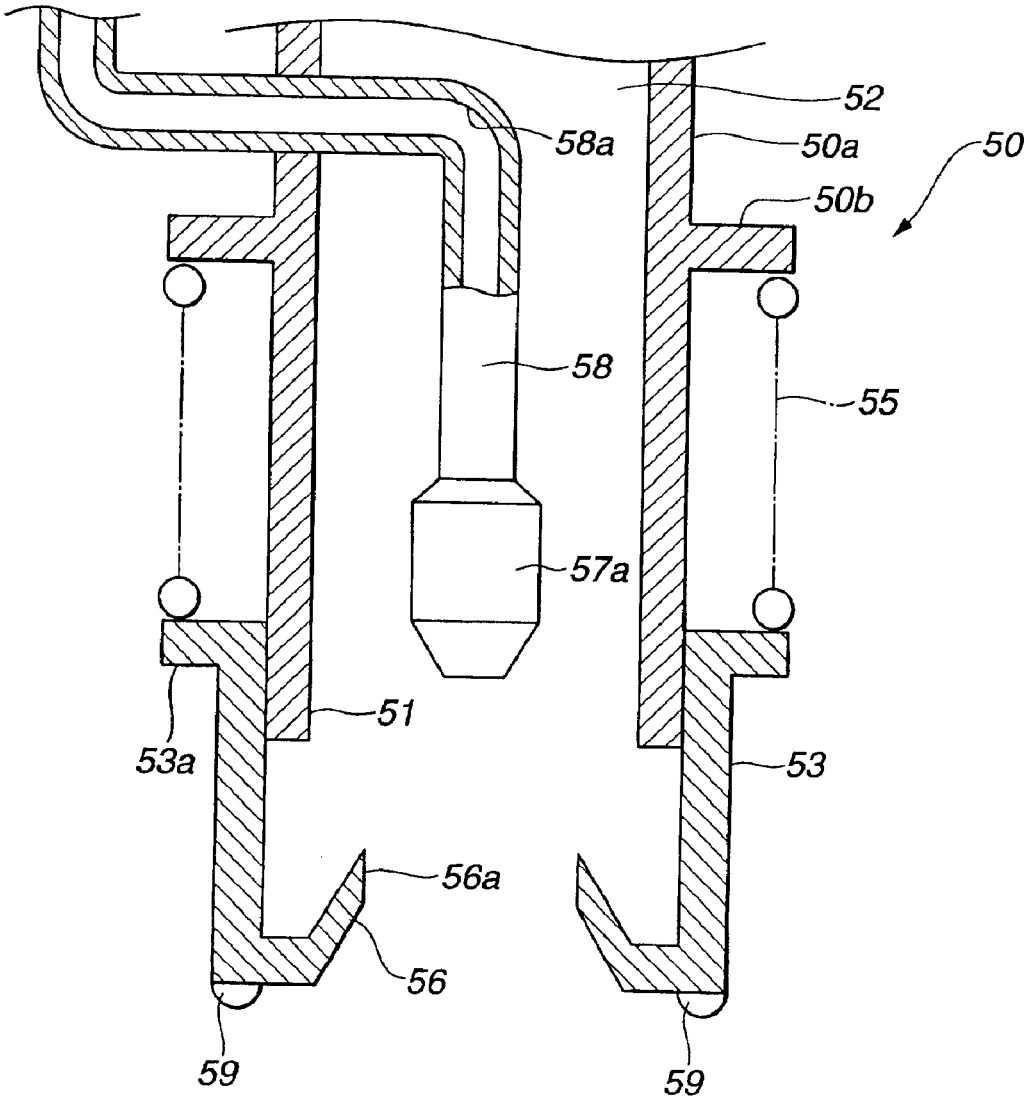
FIG. 15 is an enlarged sectional view of a principal portion of the nozzle shown in FIG. 14.
Figure 16:
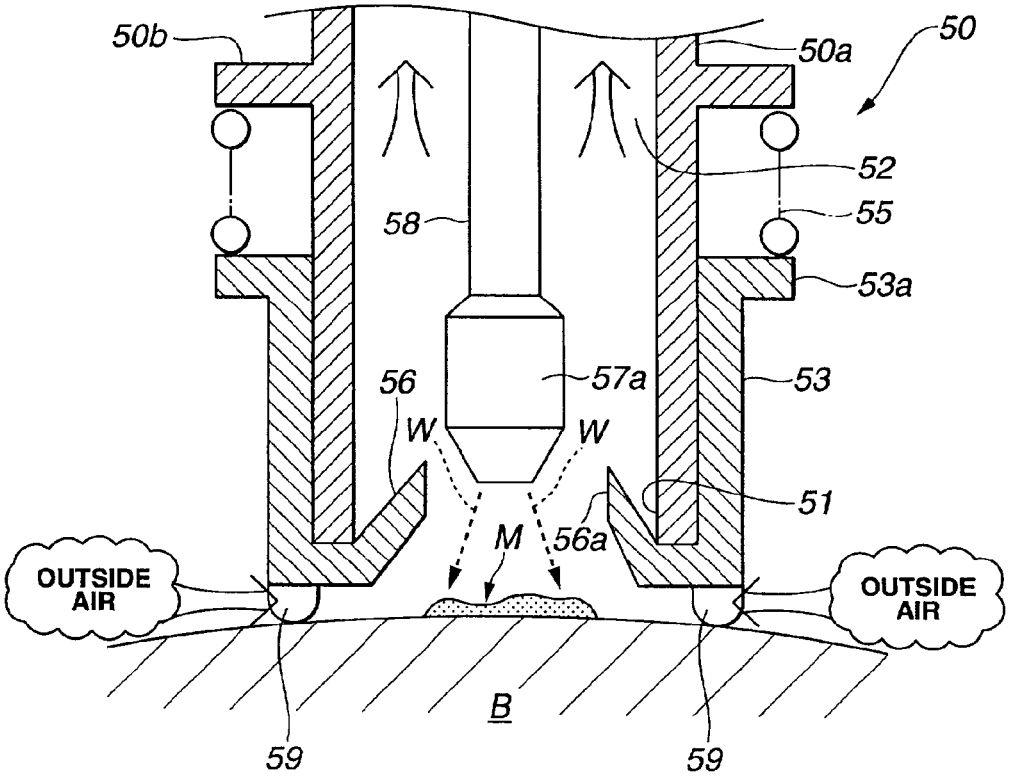
FIG. 16 is a sectional view illustrative of the working of the nozzle according to Embodiment 5 of this invention, in a state where the aspirator is operated and the work to aspirate and remove the aspiration object is being conducted.
Figure 17:
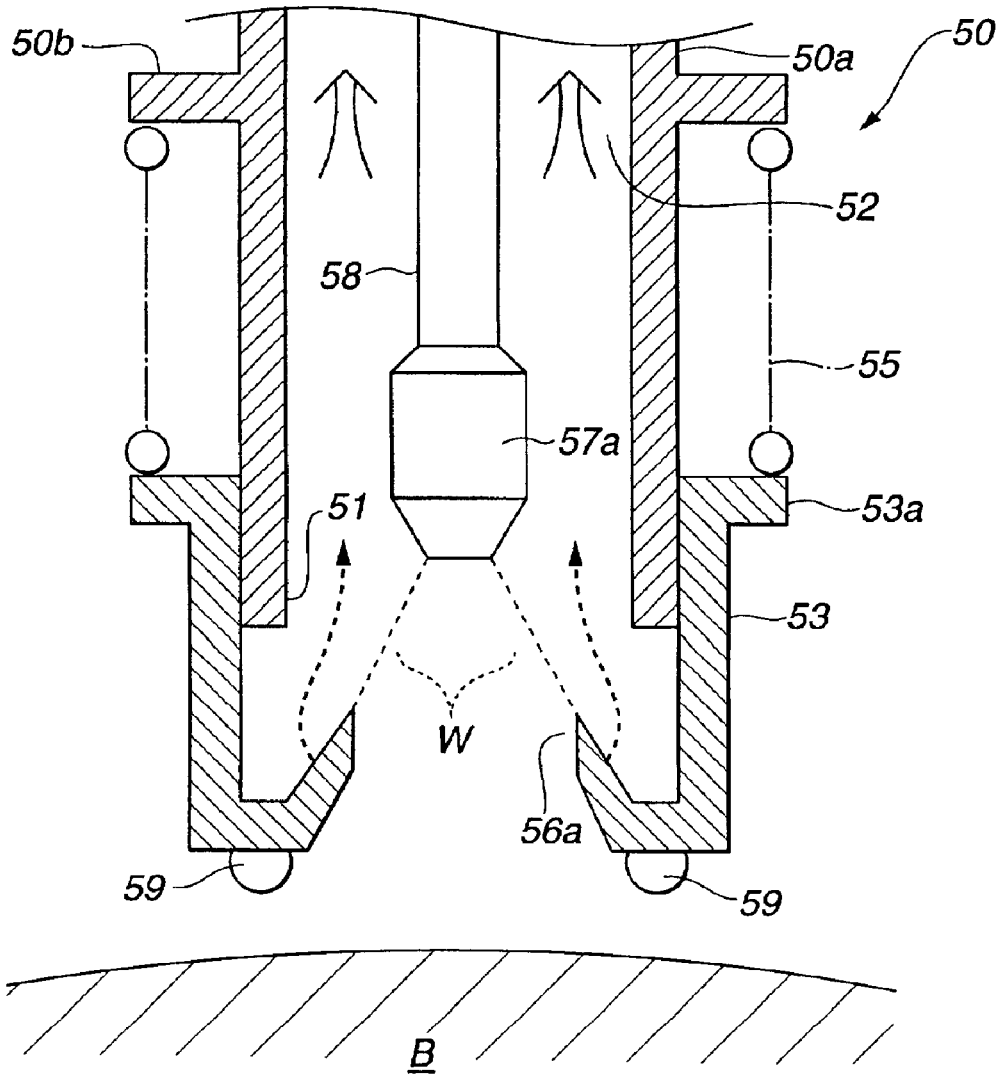
FIG. 17 is a sectional view illustrative of the working of the nozzle according to Embodiment 5 of this invention, in a state where the nozzle is moved away from the surface with the residual aspiration object while the liquid is being ejected.

FIG. 14 is a perspective view of the nozzle according to Embodiment 5. FIG. 15 is an enlarged sectional view of a principal portion of the nozzle shown in FIG. 14. FIG. 16 is a sectional view illustrative of the working of the nozzle according to Embodiment 5, in a state where the aspirator is operated and the work to aspirate and remove the aspiration object is being conducted. FIG. 17 is a sectional view illustrative of the working of the nozzle according to Embodiment 5, in a state where the nozzle is moved away from the surface with the residual aspiration object while the liquid is being ejected.

Elements of Embodiment 5 similar to those of Embodiments 1 through 4 are given the same reference numerals as in Embodiments 1 through 4 and any detailed description thereof is omitted.

As shown in FIGS. 14 and 15, a nozzle 50 according to Embodiment 5 comprises: an opening 51 which can be opposed to a surface (human body) with a residual aspiration object; a substantially cylindrical nozzle body 50*a*, which has a suction port 52 for aspirating the aspiration object; and a liquid injection device 57, which is provided at the nozzle body 50*a*, for ejecting the liquid toward the aspiration object. The aspiration object is aspirated through this nozzle 50.

The suction port 52 of the nozzle body 50*a* is connected with a hose 4 of the aspirator. An annular flange 50*b* is integrally formed on the suction port 52 side on the outer surface of the nozzle body 50*a*. This flange 50*b* serves to engage one end of a spring 55 which will be described later in detail.

The liquid injection device 57 comprises: a liquid injection device body 57*a* provided within the nozzle body 50*a*; a cylindrical shielding member 53 provided around the outer surface of the nozzle body 50*a* in a manner displaceable relative to the nozzle body 50*a*′; and a coil-shaped spring (urging means) 55 interposed between the nozzle body 50*a* and the shielding member 53.

Namely, the nozzle 50 according to Embodiment 5 is structured by connecting, via the spring 55, the shielding member 53 with the nozzle body 50*a* where the liquid injection device body 57*a* is provided in the inside space thereof. As will be described later in more detail, when the aspirator is operated, but in the state where the aspiration and removal of the aspiration object are not conducted, the liquid (such as warm water) ejected from the liquid injection device body 57*a* collides with a shielding plate 56 of the shielding member 53 and is then immediately aspirated.

The liquid injection device body 57*a* serves to eject the liquid, which is to be sprayed on the aspiration object, toward the open side of the nozzle. A plurality of liquid injection holes (not shown in the drawings) are formed so that the liquid injection device body 57*a* ejects the liquid, which is to be sprayed on the aspiration object, in an atomized form over the surface of a virtual cone which is formed with the top end of the liquid injection device body 57*a* as a vertex of the virtual cone (in such a manner that a continuous conical surface will be formed). Moreover, in Embodiment 5, in order to provide some space between the top end of the liquid injection device body 57*a* and the surface with the residual aspiration object, the top end of the liquid injection device body 57*a* is located at a position several centimeters recessed from the opening 51 of the nozzle body 50*a*.

The liquid injection device body 57*a* is supported by a crank-shaped hollow stay 58. A liquid guide passage 58*a* is formed within the stay 58 and the liquid ejected from the liquid injection device body 57*a* is supplied through this liquid guide passage 58*a* to the liquid injection device body 57*a*. The stay 58 pierces through the side wall of the nozzle body 50*a* and is fixed at such a position in a sufficiently airtight state. Moreover, the aspirator side of the stay 58 is connected with a liquid passage tube 9 extending from the aspirator.

The shielding member 53 is formed in a cylindrical shape, one end of which is incompletely blocked. Specifically, this shielding member 53 has the inside diameter which is slightly larger than the outside diameter of the nozzle body 57*a*. Accordingly, the shielding member 53 is assembled with the nozzle body 50*a* in a movable manner. In other words, the shielding member 53 is provided in a manner displaceable relative to the nozzle body 50*a*.

On one end of the shielding member 53, the shielding plate 56 is provided which blocks a part of this portion. The shielding plate 56 is annular, the center of which is a circular aperture 56*a*. This aperture 56*a* is the true suction port to aspirate the aspiration object.

When the nozzle 50 is in a natural state (in the state as shown in FIG. 15 where a pressing force is not exerted on the shielding member 53), the shielding plate 56 overlaps the edge portion of the opening 51 of the nozzle body 50*a* so that the liquid ejected from the liquid injection device body 57*a* over the surface of a virtual cone will collide with the shielding plate 56. To be more precise, a major area of the shielding plate 56, excluding the portion around the aperture 56*a*, overlaps the edge portion of the opening 51 of the nozzle body 50*a*. In Embodiment 5, the nozzle is structured in such a manner that by displacing the shielding member 53 to an end position against the urging force of the spring 55 in a direction to move the shielding plate 56 closer to the opening 51 of the nozzle body 50*a*, the liquid ejected from the liquid injection device body 57*a* is discharged outside without colliding with the shielding plate 56.

More specifically, the shielding plate 56 of the shielding member 53 is tapered in such a manner that its center portion (the portion around the aperture 56*a*) becomes narrower and contracts toward the deep end of the nozzle body 50*a* (or becomes wider and expands toward the aspiration object side). It is structured in such a manner that the liquid sprayed on the aspiration object will be discharged outside through the aperture 56*a* existing at the center of the tapered portion (or protuberant portion) of the shielding plate 56.

On the hose 4 side of the shielding member 53, an annular flange 53*a* is integrally formed as in the case of the nozzle body 50*a*. This flange 53*a* engages the other end of the spring 55.

The above-described structure allows the spring 55 to be located around the nozzle body 50*a* and between the flange 50*b* and the flange 53*a*. Although it is not explained above, the spring 55 exerts, on the nozzle body 50*a* and the shielding member 53, a force to move the shielding plate 56 of the shielding member 53 away from the opening 51 of the nozzle body 50*a*. Accordingly, the nozzle 50 maintains its natural state as shown in FIG. 15 unless any artificial pressing force (a force to compress the spring 55) is applied to the shielding member 53.

The nozzle 50 according to Embodiment 5 requires a mechanism for preventing the shielding member 53 from dropping (or slipping down the nozzle body 50*a*), and the spring 55 also serves as this dropping prevention mechanism. Specifically, both ends of the spring 55 are fixed respectively at the flange 50*b* and the flange 53*a* so that these ends are restricted from becoming separated beyond a certain distance. However, this dropping prevention mechanism may be structured by providing latch pieces respectively at the nozzle body 50*a* and the shielding member 53.

In Embodiment 5, a stroke of the shielding member 53 (or a distance that the shielding member 53 can move back) is about several centimeters. Particularly in this example, the stroke is set at about 2 cm.

In addition, a plurality of projections 59 are formed in a peripheral direction on the end face of the shielding member 53, which is opposed to the surface with the residual aspiration object, that is, on the face around the tapered portion (or protuberant portion) of the shielding plate 56. These projections 59 serve to form a given space between the surface with the residual aspiration object (the surface of the human body) and the shielding plate 56. Accordingly, the ambient outside air is introduced into the nozzle body 50*a*. As a result, the nozzle 50 will not excessively adsorb to the surface with the residual aspiration object.

Since these projections 59 directly contact the human body, they are made of, for example, soft materials such as rubber in order not to hurt the skin. Moreover, the top ends of the projections 59 are rounded.

On the outer surface of the nozzle 50, a cylindrical cover may be provided which can cover the spring 55.

An explanation is hereinafter given about the working of the nozzle 50 according to Embodiment 5 by referring to FIGS. 16 and 17.

As shown in FIG. 16, the aspirator is operated to spray a liquid W on an aspiration object M (solidified residual excrements on the human body B) in order to conduct the work to aspirate and remove the aspiration object M. At this time, the nozzle 50 is pushed against the surface of the human body B with the residual aspiration object. Namely, the shielding member 53 is displaced to the end position in a direction to move the shielding plate 56 closer to the opening 51 of the nozzle body 50*a*. Accordingly, the liquid W ejected from the liquid injection body 57*a* is sprayed on the aspiration object M without being blocked by the shielding plate 56, as shown in FIG. 16, and the aspiration object M then quickly comes off the surface where it has remained. As a result, excellent aspiration and removal performance is exhibited. Moreover, since in this state the outside air is introduced with substantial force through the spaces between the projections 59 into the nozzle body 50*a*, the liquid W which has collided with the aspiration object M will not disperse outside.

When the nozzle 50 is moved away from the surface with the residual aspiration object M while the liquid W is being ejected as shown in FIG. 17, the force to push the shielding member 53 against the surface with the residual aspiration object M is released. Subsequently, the urging force (or restoring force) of the spring 55 which has been compressed makes the shielding member 53 immediately return to its original position (the position in a natural state). As a result, the ejected liquid W is blocked by the shielding plate 56 of the shielding member 53 as shown in FIG. 17. In other words, the liquid W ejected from the liquid injection device body 57*a* over the surface of a virtual cone collides with the shielding plate 56 and the liquid droplets are then immediately aspirated. Consequently, as the liquid W is reversed within the nozzle body 50*a* without dispersing outside, the liquid W will never disperse around even if the nozzle 50 is moved away from the surface with the residual aspiration object M during the aspiration and removal work while the liquid W is being ejected. Therefore, such a problem of soiling the surroundings with the dispersed liquid W will not occur.

Furthermore, the nozzle 50 according to Embodiment 5 does not require a complicated control system which uses, for example, a sensor in order to achieve such excellent effects as described above. In other words, since the structure of the nozzle is very simple, it is possible to provide the nozzle at low cost.

In Embodiment 5, it is desirable that the shielding plate 56 be tapered as described above. Alternatively, however, the shielding plate 56 may be formed in a flat doughnut shape.

Moreover, in Embodiment 5, the liquid W is ejected in an atomized form over the surface of the virtual cone as described above. However, the nozzle may be structured in such a manner that several streams of the liquid W are sprayed on the aspiration object M over the surface of the virtual cone. In other words, such a structure may be adopted that the liquid is ejected in a plurality of respectively independent lines. More specifically, the injection form of the liquid W should not necessarily be over the surface of the virtual cone, but it is possible to obtain a desirable injection form by changing the shape of the shielding member 53, particularly the shielding plate 56.

As stated above, even if the nozzle 50 according to Embodiment 5 is moved away from the surface with the residual aspiration object during the aspiration work while the liquid is being ejected, the liquid will not disperse around. Moreover, the simple structure can achieve such effects.

(Embodiment 6)

An explanation is hereinafter given about a nozzle according to Embodiment 6 of this invention by referring to the relevant drawings. Just like the nozzles according to Embodiments 2 and 5, the nozzle according to Embodiment 6 is also connected to an aspirator and is used to aspirate an aspiration object. Embodiment 6 also explains about the case where the nozzle is connected with the aspirator of Embodiment 1.

Figure 18:
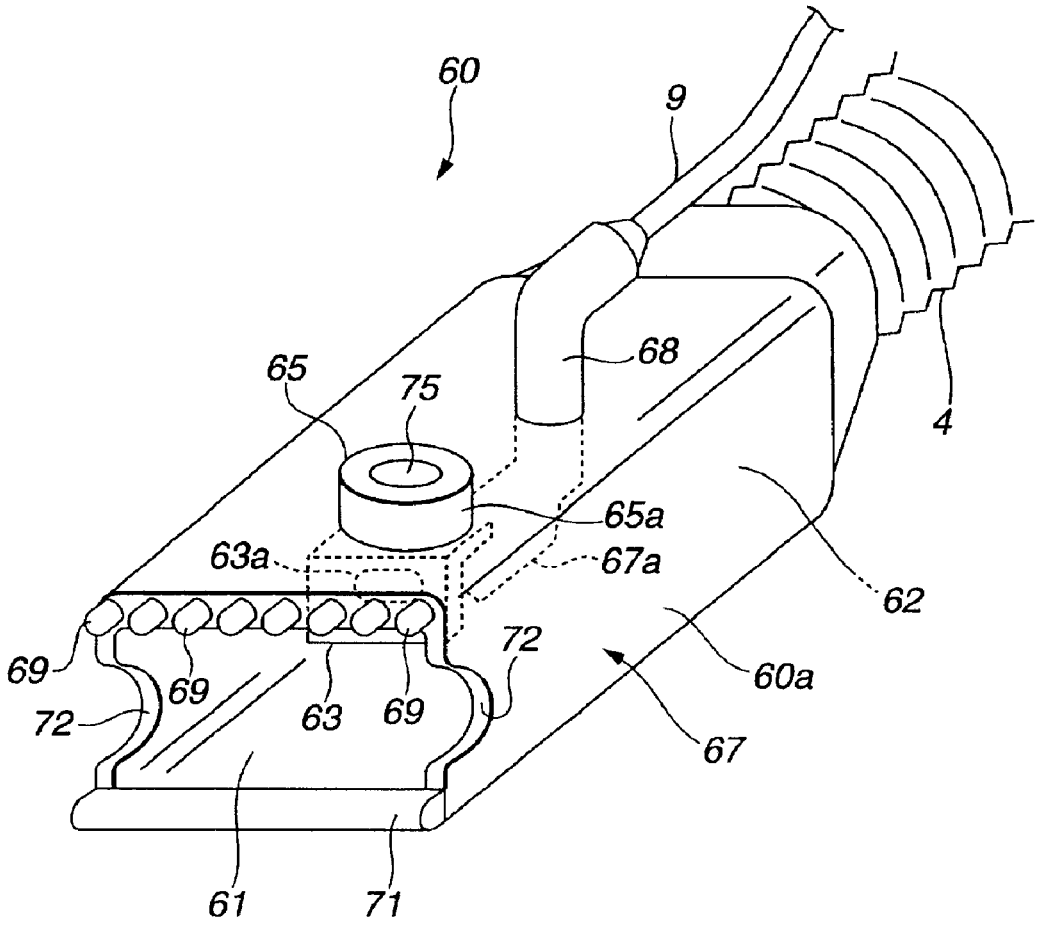
FIG. 18 is a perspective view of a nozzle according to Embodiment 6 of this invention.
Figure 19:
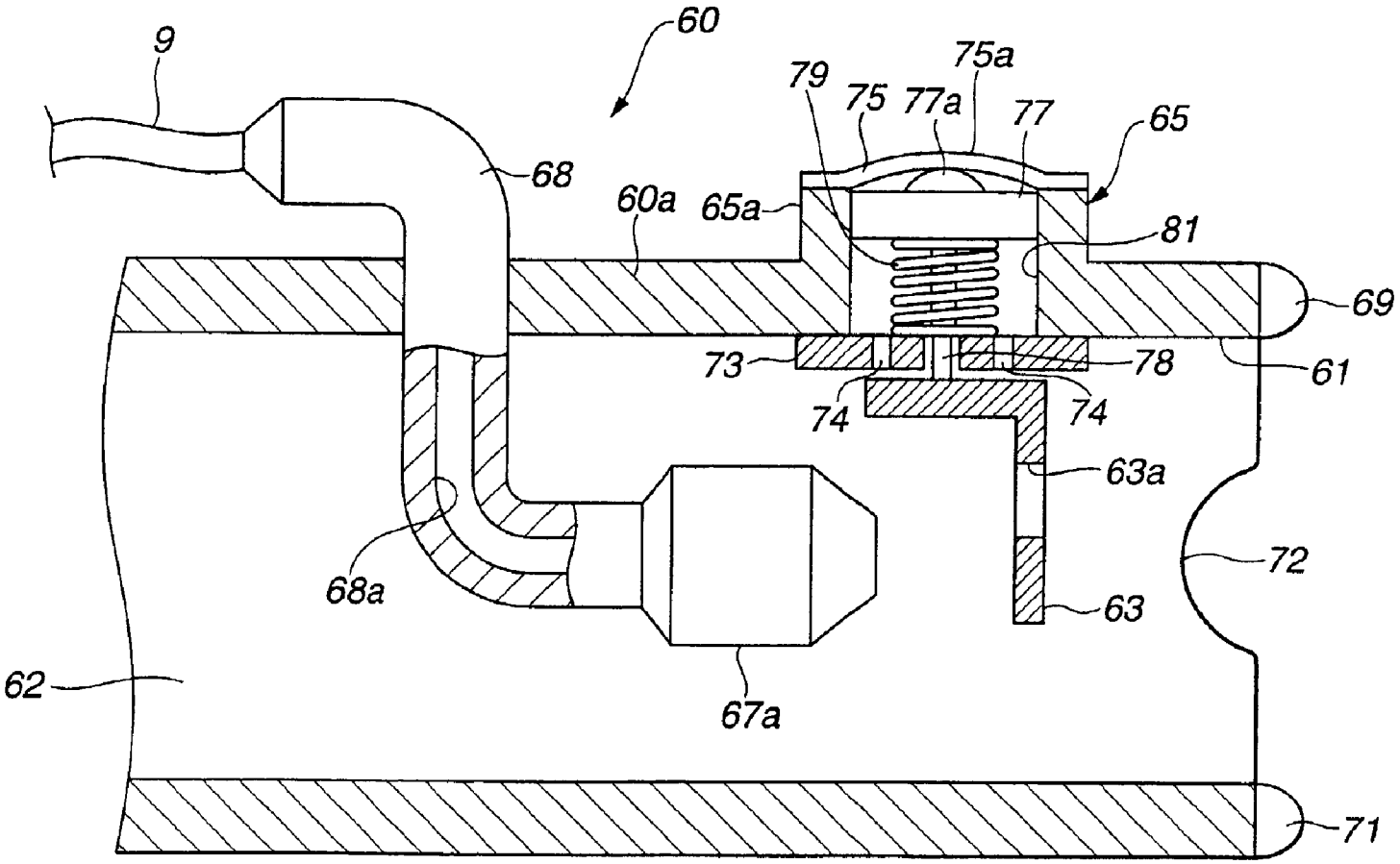
FIG. 19 is an enlarged sectional view of the nozzle shown in FIG. 18.
Figure 20:
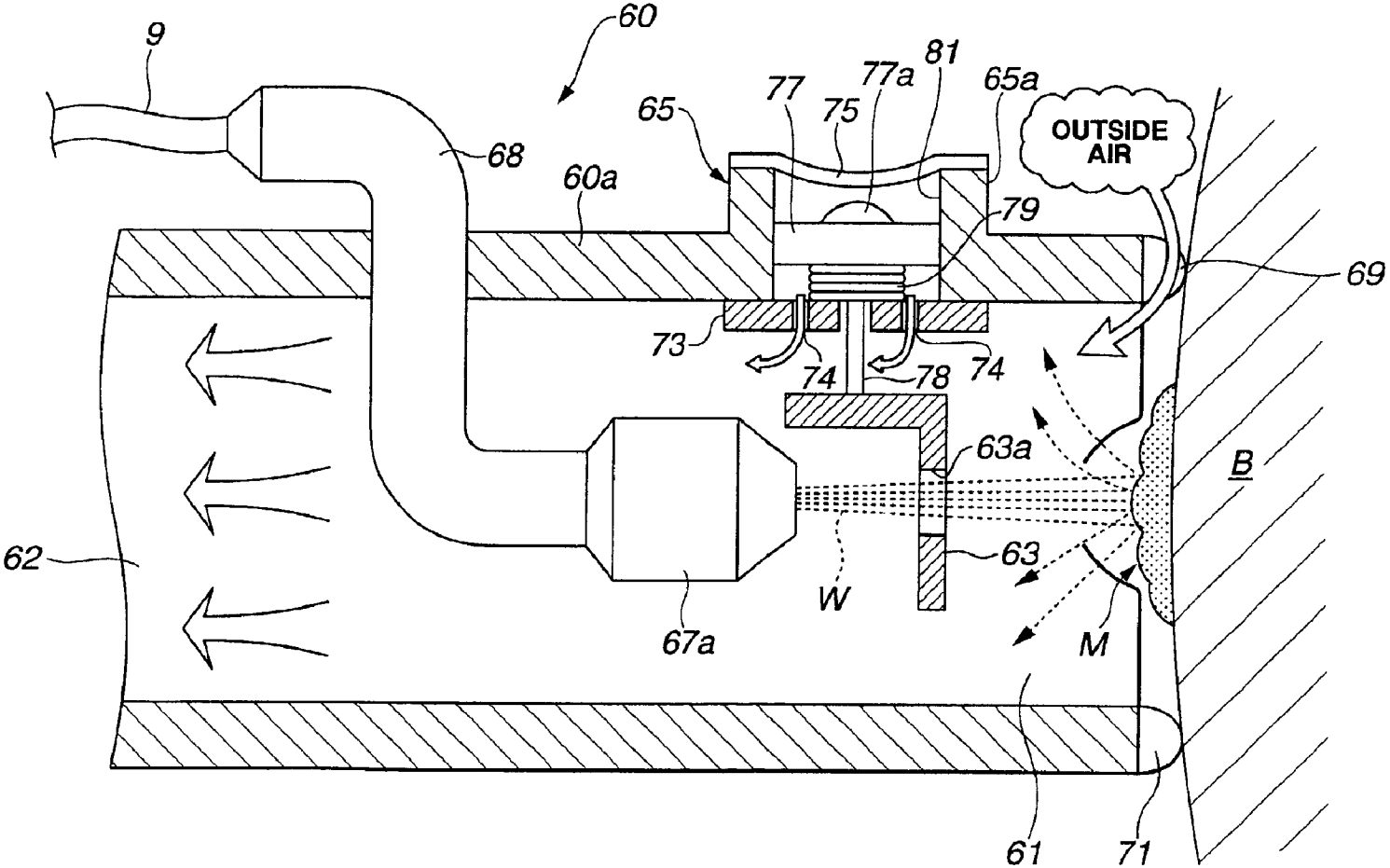
FIG. 20 is a sectional view illustrative of the working of the nozzle according to Embodiment 6 of this invention, in a state where the aspirator is operated and the work to aspirate and remove the aspiration object is being conducted.
Figure 21:
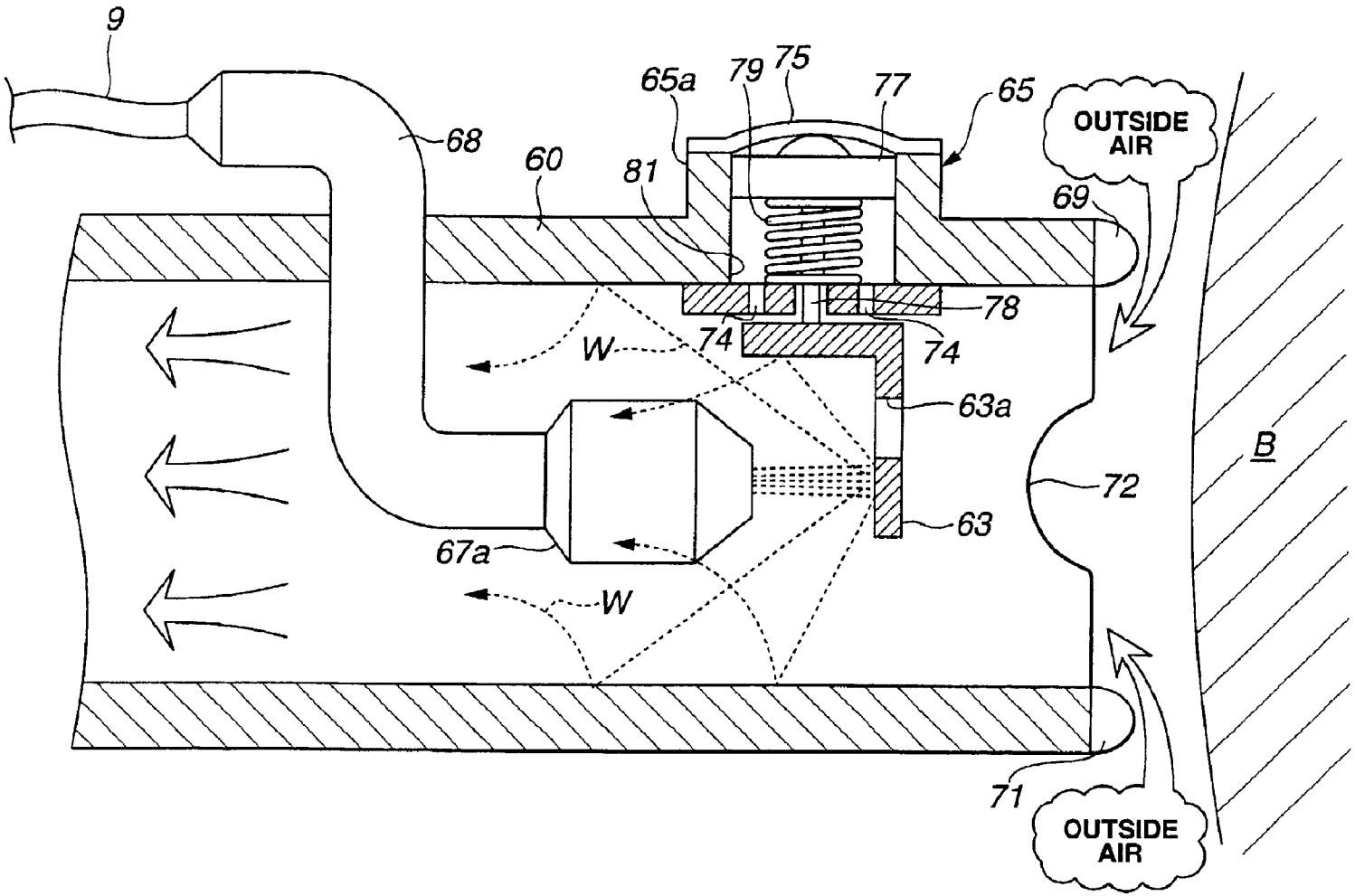
FIG. 21 is a sectional view illustrative of the working of the nozzle according to Embodiment 6 of this invention, in a state where the nozzle is moved away from the surface with the residual aspiration object while liquid is being ejected.

FIG. 18 is a perspective view of the nozzle according to Embodiment 6. FIG. 19 is an enlarged sectional view of the nozzle shown in FIG. 18. FIG. 20 is a sectional view illustrative of the working of the nozzle according to Embodiment 6, in a state where the aspirator is operated and the work to aspirate and remove the aspiration object is being conducted. FIG. 21 is a sectional view illustrative of the working of the nozzle according to Embodiment 6, in a state where the nozzle is moved away from the surface with the residual aspiration object while liquid is being ejected.

Elements of Embodiment 6 similar to those of Embodiments 1 through 5 are given the same reference numerals as in Embodiments 1 through 5 and any detailed description thereof is omitted.

As shown in FIGS. 18 through 21, a nozzle 60 according to Embodiment 6 comprises an opening 61 which can be opposed to a surface (human body) with a residual aspiration object, a nozzle body 60*a* which has a suction port 62 for aspirating the aspiration object, and a liquid injection device 67, which is provided at the nozzle body 60*a*, for ejecting the liquid toward the aspiration object. The aspiration object is aspirated through this nozzle 60.

The nozzle body 60*a* is in a substantially rectangular parallelopiped shape (rectangular trunk shape) which is hollow. The suction port 62 is connected with a hose 4 extending from the aspirator. On the nozzle body 60*a*, a guide wall 65*a* is integrally formed, which composes a driving device 65 which will be described later in more detail. In other words, a circular hole which links the inside of the nozzle body 60*a* to the outside thereof is made in the nozzle body 60*a*.

On the end face of the opening 61 of the nozzle body 60*a*, which is opposed to the surface with the residual aspiration object, particularly on the end face of a face member with the driving device 65 provided there at as described later, a plurality of projections 69 are formed in a row (that is, in a peripheral direction of the opening 61 of the nozzle body 60*a*). The top ends of the projections 69 are formed in a hemispherical shape, and the projections 69 serve to form a given space between the surface with the residual aspiration object (the surface of the human body) and the end face of the opening 61 of the nozzle body 60*a*. Accordingly, the ambient outside air is introduced into the nozzle body 60*a*. As a result, the nozzle 60 will not excessively adsorb to the surface with the residual aspiration object.

On the other hand, another end face of the opening 61, which is positioned below the end face with the projections 69, is covered with a continuous long pad 71 which is hemicircle in cross section. Moreover, the two other end faces (or edges to be more precise) of the nozzle body 60*a* have substantially arcuate notches 72. Just like the projections 69, these notches 72 serve to introduce the ambient outside air into the nozzle body 60*a*.

The liquid injection device 67 comprises, on the side closer to the opening: a liquid injection device body 67*a* for ejecting liquid to be sprayed on the aspiration object; a shielding plate 63 which is substantially in a shape of the letter L in cross section and is provided within the nozzle body 60*a*; and the driving device 65 connected to the shielding plate 63 in order to displace the shielding plate 63. As described later in more detail, when the aspirator is operated and in the state where the aspiration and removal of the aspiration object is not being conducted, the liquid (such as warm water) ejected from the liquid injection device 67 collides with the shielding plate 63 and the liquid droplets are then immediately aspirated.

The liquid injection device body 67*a* is supported by a crank-shaped hollow stay 68. A liquid guide passage 68*a* is formed within the stay 68 and the liquid ejected from the liquid injection device body 67*a* is supplied through this liquid guide passage 68*a* to the liquid injection device body 67*a*. The stay 68 pierces through the side wall of the nozzle body 60*a*, where the stay 68 is fixed in a sufficiently airtight state. Moreover, the aspirator side of the stay 68 is connected with a liquid passage tube 9 extending from the aspirator.

The shielding plate 63 is provided in a displaceable manner in a direction perpendicular to an axial direction of the nozzle body 60*a*. In the state where the pressure within the nozzle body 60*a* has not reached a sufficiently negative pressure, that is, when the nozzle body 60*a* is moved away from the surface with the residual aspiration object, the shielding plate 63 exists on the side wall side where the projections 69 are formed and the liquid ejected from the liquid injection device body 67*a* collides with a part of the shielding plate 63.

In a vertical plane portion of the shielding plate 63, an oval (or rectangular) aperture 63*a* is formed. During the work to aspirate and remove the aspiration object (that is, when the driving device 65 is operated to displace the shielding plate 63), the liquid ejected from the liquid injection device body 67*a* passes through this aperture 63*a*. The place where the liquid ejected from the liquid injection device body 67*a* collides with when the pressure within the nozzle body 60*a* has not reached a sufficient negative pressure is the portion of the shielding plate 63 off the aperture 63*a* and on the side closer to the side wall of the nozzle body 60*a* where the pad 71 is formed.

The driving device 65 is connected with the shielding plate 63 as described above and serves to displace the shielding plate 63 toward the side wall of the nozzle body 60*a* where the pad 71 is formed by utilizing a pressure difference between atmospheric pressure and a negative pressure when the pressure within the nozzle body 60*a* becomes a sufficient negative pressure. As described later in more detail, as the driving device 65 operates and displaces the shielding plate 63 to a position closest to the side wall of the nozzle body 60*a* where the pad 71 is formed, the liquid ejected from the liquid injection device body 67*a* no longer collides with the shielding plate 63. In other words, the liquid passes through the aperture 63*a* in the shielding plate 63. Consequently, the nozzle 60 is structured in such a manner that the liquid ejected from the liquid injection device body 67*a* is discharged outside through the opening 61 of the nozzle body 60*a*.

This driving device 65 comprises, as its main components: the annular guide wall 65*a* described above; a piston member provided in a space within the guide wall 65*a*; a shaft member 78 for connecting the piston member 77 with the shielding plate 63 (particularly its horizontal plane portion); and a coil-shaped spring (urging means) 79 for urging the piston member 77 toward the side wall of the nozzle body 60*a* where the projections 69 are formed.

The guide wall 65*a* is mounted around a circular hole 81 formed in the nozzle body 60*a*. The piston member 77 is placed within the guide wall 65*a* so that it can be displaced relative to the guide wall 65*a* while a sufficiently airtight condition is maintained. Moreover, the spring 79 exists around the shaft member 78 and exerts a restoring force on the piston member 77 toward the side wall of the nozzle body 60*a* where the projections 69 are formed so that the piston member 77 will move away from the inside space of the nozzle body 60*a*.

Namely, the driving device 65 is structured in such a manner that when the pressure within the nozzle body 60*a* becomes a sufficiently negative pressure, a pressure difference between atmospheric pressure and the negative pressure makes the piston member 77 to be displaced downward (in a direction to approach the inside space of the nozzle body 60*a*) against the urging force of the spring 79, and the displacement of the piston member 77 further displaces the shielding plate 63 through the intermediary of the shaft member 78.

The spring 79 is supported by a base plate 73 which is a separate member from the nozzle body 60*a*. Namely, the spring 79 is interposed between the piston member 77 and the base plate 73 attached to the inner surface of the nozzle body 60*a*. A perforating hole for inserting the shaft member 78 exists at the center of the base plate 73. Moreover, around this perforating hole, a plurality of air holes 74 are formed for making the negative pressure effectively act on the space within the guide wall 65*a*. However, in order to restrain the shielding plate 63 from turning around, both the cross sections of the shaft member 78 and the center perforating hole of the base plate 73 are made rectangular.

The guide wall 65*a* (accordingly the driving device 65) is formed at such a position that the piston member 77 existing within the guide wall 65*a* can be pressed with a fingertip, particularly the tip of a thumb, so that it is also possible to eject the liquid manually if necessary.

In Embodiment 6, in order to further ensure the action of the driving device 65, the open side of the guide wall 65*a*, which is opposed to the side of the piston member 77 opposite to the spring 79, is blocked with a film member 75 which is impermeable to gas, such as a plastic film. In order to enhance the easy operability at the time of manual operation, a convex 77*a* is provided on the surface of the piston member 77 on the side opposite to the spring 79, and a convex 75*a* is provided on the film member 75. The film member 75 may have a hole of about a pinhole size formed therein.

An explanation is hereinafter given about the function of the nozzle 60 according to Embodiment 6 by referring to FIGS. 20 and 21.

FIG. 20 illustrates the state where the aspirator is operated to spray a liquid W on an aspiration object M (solidified residual excrements on the human body B), so that the work to aspirate and remove the aspiration object M is being conducted. At this time, the pressure within the nozzle body 60*a* has become a sufficiently negative pressure and, therefore, the driving device 65 functions as described above and the shielding plate 63 is displaced toward the side wall of the nozzle body 60*a* where the pad 71 is formed. Accordingly, the liquid W ejected from the liquid injection device body 67*a* does not collide with the shielding plate 63, but is discharged outside through the aperture 63*a* in the shielding plate 63 and then from the opening 61 of the nozzle body 60*a*.

As shown in FIG. 20, the ejected liquid W is sprayed on the aspiration object M without being blocked by anything, and the aspiration object M then quickly comes off the surface where it has remained. As a result, excellent aspiration and removal performance is exhibited. Moreover, since in this state the ambient outside air is introduced with substantial force into the nozzle, the liquid W which has collided with the aspiration object M will not disperse outside.

When the nozzle is moved away from the surface with the residual aspiration object M while the liquid W is being ejected, the internal pressure of the nozzle body 60*a* immediately rises. In other words, a pressure difference between the atmospheric pressure and the internal pressure (that is, negative pressure) of the nozzle body 60*a* decreases to a value equal to or less than an operating threshold value of the driving device 65. Accordingly, the shielding plate 63 returns to its original position. As a result, the liquid ejected from the liquid injection device body 67*a* collides with and is blocked by the shielding plate 63 as shown in FIG. 21, and the liquid droplets are then immediately aspirated.

The liquid W ejected from the liquid injection device body 67*a* is reversed within the nozzle body 60*a* and will not be discharged outside through the opening 61 of the nozzle body 60*a*. Consequently, even if the nozzle 60 is moved away from the surface with the residual aspiration object M during the aspiration and removal work while the liquid W is being ejected, the liquid W will never disperse around. Therefore, such a problem of soiling the surroundings with the dispersed liquid W will never occur.

Furthermore, the nozzle 60 according to Embodiment 6 does not require any complicated control system which uses, for example, a sensor in order to achieve such special effects as described above. Accordingly, the structure of the nozzle is very simple and, therefore, it is possible to provide the nozzle at low cost.

In Embodiment 6, such a structure is employed that the shielding plate 63 is displaced directly by the shaft member 78 of the driving device 65. However, without limitation to this structure, such another structure may be employed that the shielding plate 63 is displaced indirectly by the shaft member 78 of the driving device 65 (accordingly the piston member 77) by applying, for example, the lever principle.

Figure 22:
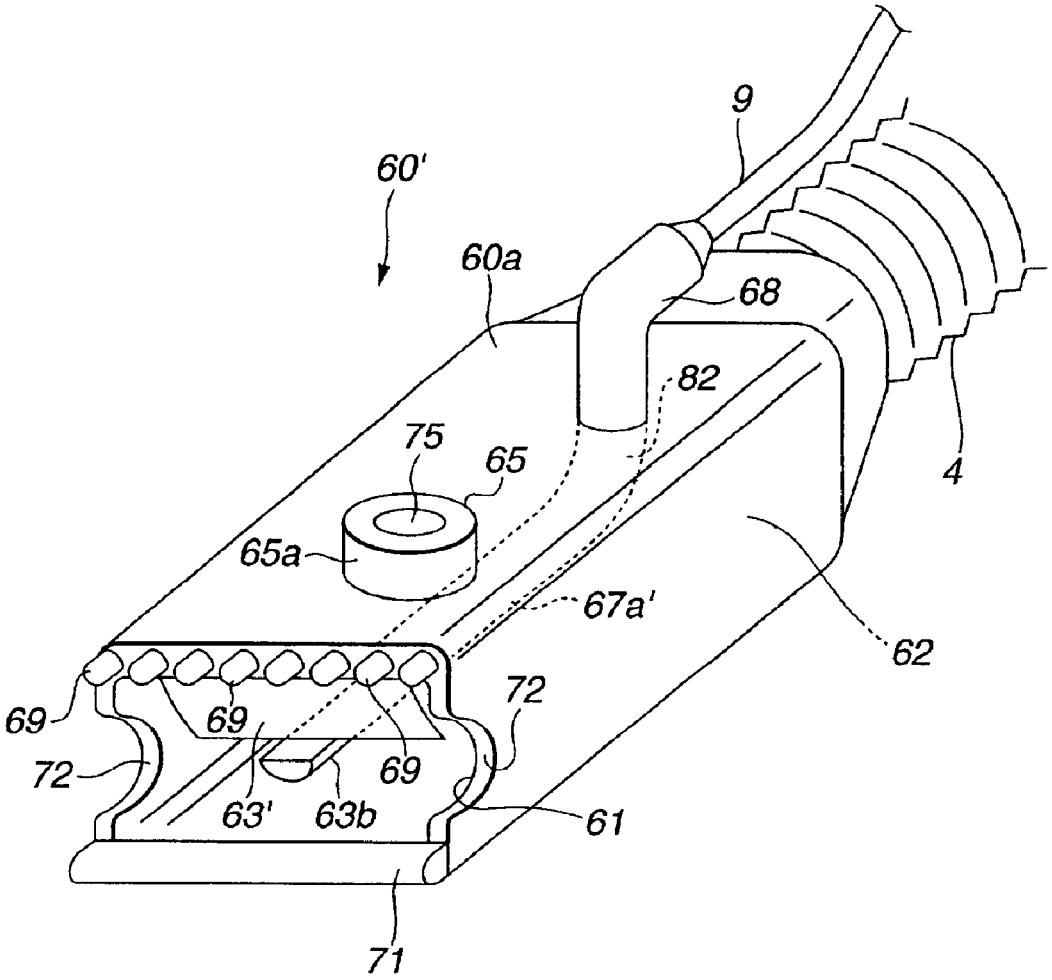
FIG. 22 is a perspective view of a variation example of the nozzle according to Embodiment 6 of this invention.
Figure 23:
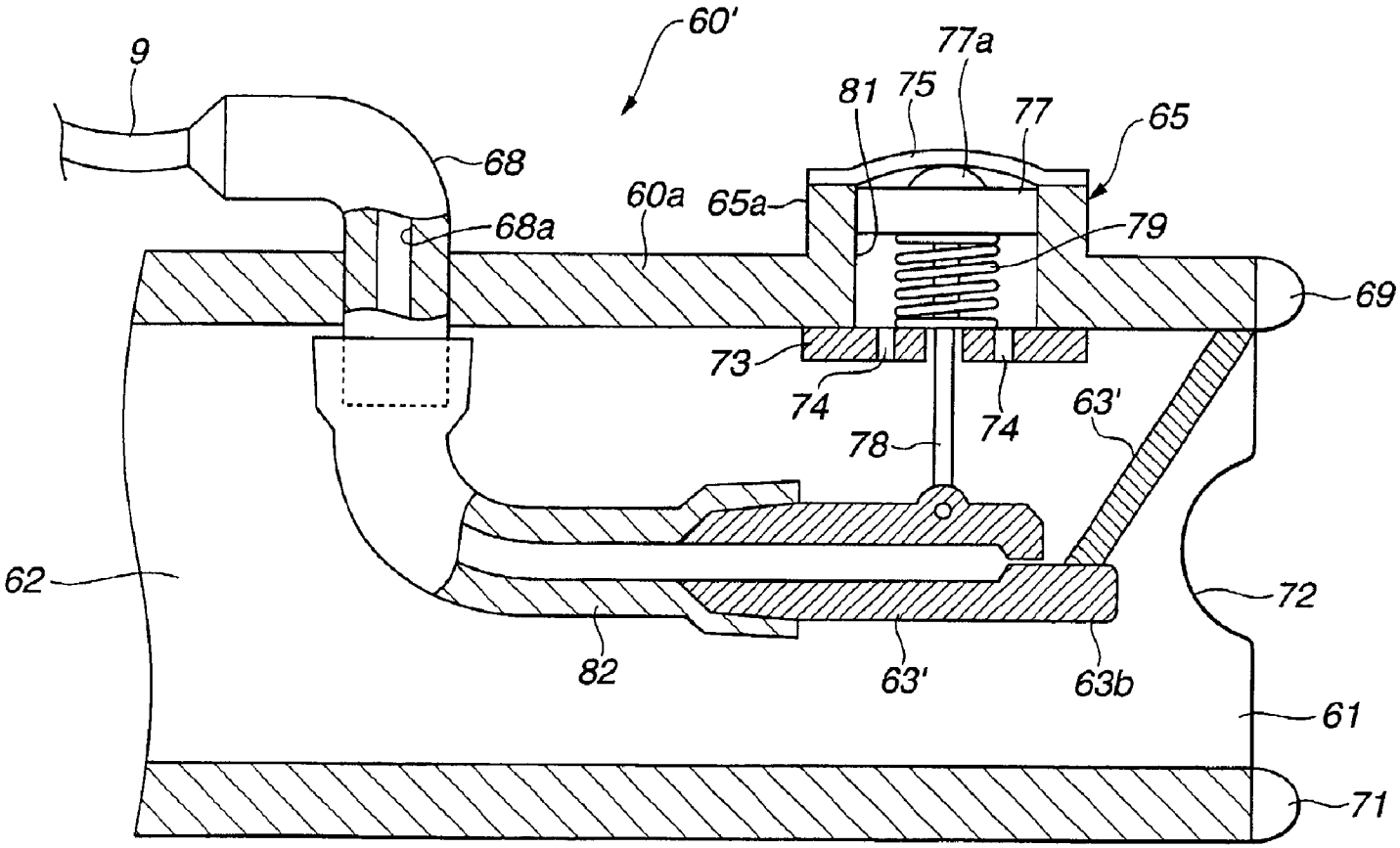
FIG. 23 is an enlarged sectional view of a principal portion of the nozzle shown in FIG. 22.
Figure 24:
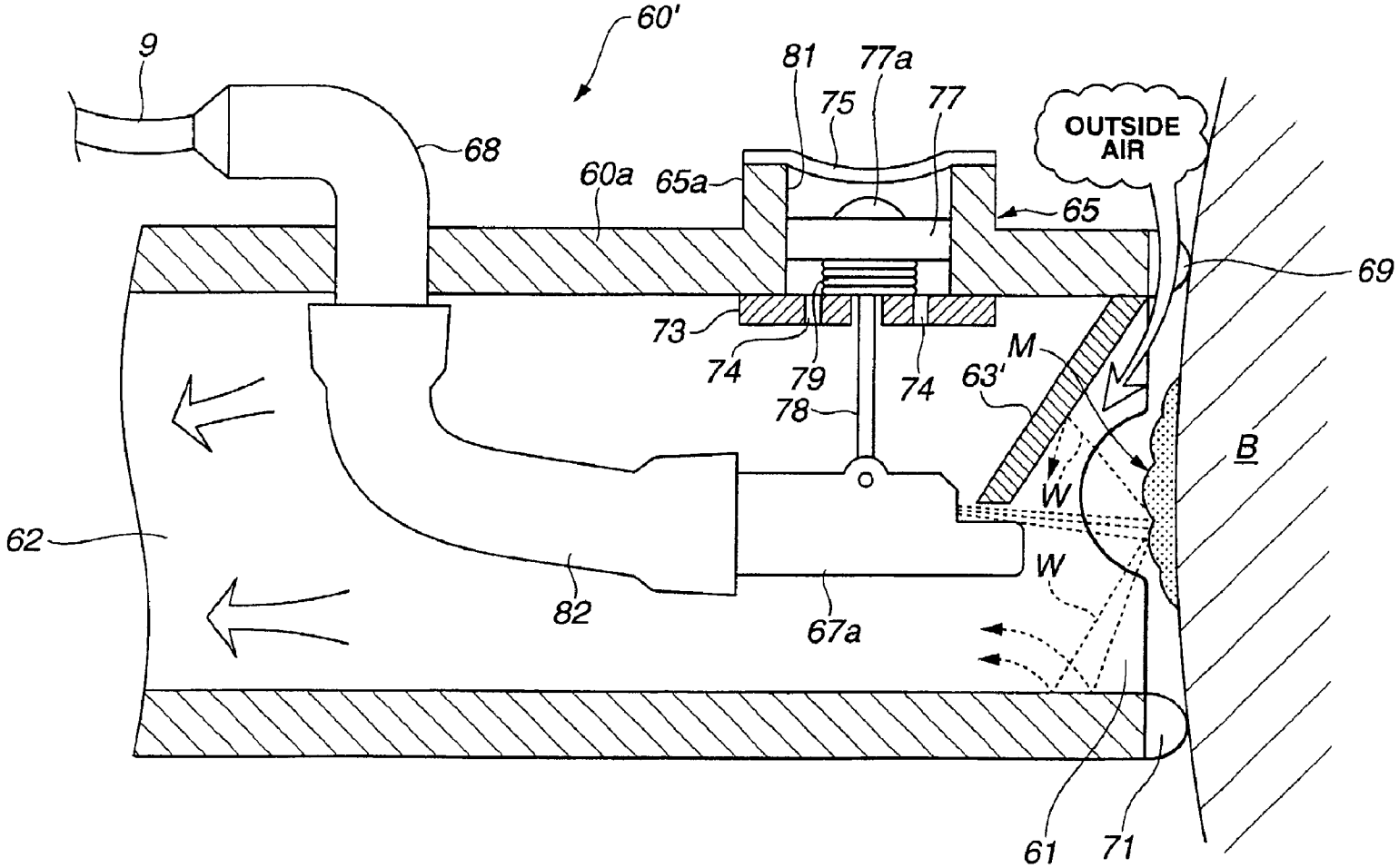
FIG. 24 is a sectional view illustrative of the working of the nozzle shown in FIGS. 22 and 23, in a state where the aspirator is operated and the work to aspirate and remove the aspiration object is being conducted.
Figure 25:
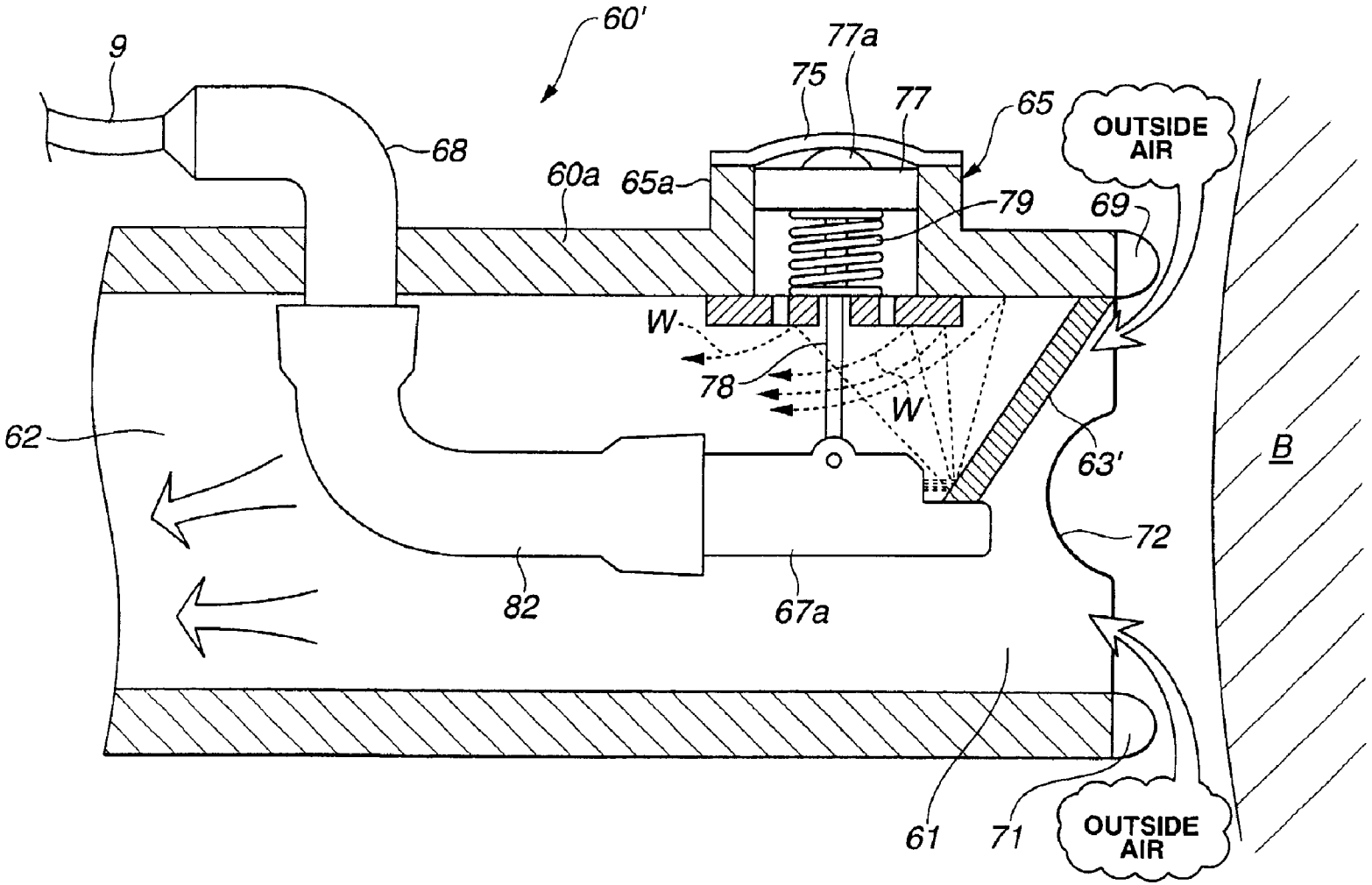
FIG. 25 is a sectional view illustrative of the working of the nozzle shown in FIGS. 22 and 23, in a state where the nozzle is moved away from the surface with the residual aspiration object while the liquid is being ejected.

A variation example of the nozzle 60 according to Embodiment 6 is hereinafter explained with reference to the relevant drawings. FIG. 22 is a perspective view of a variation example of the nozzle according to Embodiment 6. FIG. 23 is an enlarged sectional view of a principal portion of the nozzle shown in FIG. 22. FIG. 24 is a sectional view illustrative of the working of the nozzle shown in FIGS. 22 and 23, in a state where the aspirator is operated and the work to aspirate and remove the aspiration object is being conducted. FIG. 25 is a sectional view illustrative of the working of the nozzle shown in FIGS. 22 and 23, in a state where the nozzle is moved away from the surface with the residual aspiration object while the liquid is being ejected.

As for this variation example, its basic technical concept and basic structure are the same as those of the embodiment described above. Accordingly, the following description is mainly focused on differences from the above-described embodiment.

As shown in FIGS. 22 through 25, a nozzle 60' comprises a trunk-shaped nozzle body 60*a* and a liquid injection device 67', which is provided at the nozzle body 60*a*, for ejecting liquid toward an aspiration object. The aspiration object is aspirated through this nozzle 60'. Since the nozzle body 60*a* is similar to that of the embodiment described above, any detailed description thereof is omitted.

The liquid injection device 67' comprises: a liquid injection device body 67*a'* provided in a tiltable manner within the nozzle body 60*a*; a shielding plate 63' provided within the nozzle body 60*a*; and a driving device 65 connected to the liquid injection device body 67*a'* so as to tilt the liquid injection device body 67*a'*. As described later in more detail, when the aspirator is operated and in the state where the aspiration and removal of the aspiration object is not being conducted, the liquid (such as warm water) ejected from the liquid injection device body 67*a'* collides with the shielding plate 63', and the liquid droplets are then immediately aspirated.

The liquid injection device body 67*a'* is connected with a stay 68 through a flexible tube 82. Specifically speaking, the liquid ejected from the liquid injection device body 67*a'* is supplied through the inside of a liquid guide passage 68*a* and the tube 82 to the liquid injection device body 67*a'*.

The shielding plate 63' is provided (or fixed) in a slanting state within the nozzle body 60*a* to block approximately half of the opening 61. When the pressure within the nozzle body 60*a* has not become a sufficiently negative pressure, that is, in the state where the nozzle body 60*a* is moved away from the surface with the residual aspiration object, the liquid injection device body 67*a'* is in parallel with the axial direction of the nozzle body 60*a* and the liquid ejected from the liquid injection device body 67*a'* collides with an edge of the shielding plate 63' closer to the pad 71 side.

The shielding plate 63' contacts the top end side (an extending part 63*b*) of the liquid injection device body 67*a'* and serves to restrain the tilting of the liquid injection device body 67*a'*. Specifically speaking, in the state where the pressure within the nozzle body 60*a* has not become a sufficiently negative pressure, the horizontal state of the liquid injection device body 67*a'* (the state where the liquid injection device body 67*a'* is in parallel with the axial direction of the nozzle body 60*a*) is maintained because of the existence of the shielding plate 63'. A gap of about several millimeters is formed between the shielding plate 63' and the top end (liquid injection hole) of the liquid injection device body 67*a'*.

The driving device 65 connected with the liquid injection device body 67*a'* is structured in a manner similar to that of the embodiment described above and, therefore, any detailed description thereof is omitted. In this example, the shaft 78 is pinned and coupled with the liquid injection device body 67*a'*. When the pressure within the nozzle body 60*a* becomes a sufficiently negative pressure, the driving device 65 serves to tilt the liquid injection device body 67*a'* clockwise as in FIG. 23 by utilizing a pressure difference between atmospheric pressure and the negative pressure. As the driving device 65 operates and tilts the liquid injection device body 67*a'* to an end position, the liquid ejected from the liquid injection device body 67*a'* no longer collides with the shielding plate 63'. The nozzle 60' is structured in this manner to cause the liquid ejected from the liquid injection device body 67*a'* to be discharged outside through the opening 61 of the nozzle body 60*a*.

An explanation is hereinafter given about the function of the nozzle 60' which is the variation example of Embodiment 6 by referring to FIGS. 24 and 25.

FIG. 24 illustrates the state where the aspirator is operated to spray a liquid W on an aspiration object M (solidified residual excrements on the human body B), so that the work to aspirate and remove the aspiration object M is being conducted. At this time, the pressure within the nozzle body 60*a* has become a sufficiently negative pressure and, therefore, the driving device 65 functions as described above and the top end of the liquid injection device body 67*a'* is tilted toward the pad 71 side. Accordingly, the liquid W ejected from the liquid injection device body 67*a'* does not collide with the shielding plate 63', but is discharged outside through the opening 61 of the nozzle body 60*a*.

As shown in FIG. 24, the ejected liquid W is sprayed on the aspiration object M without being blocked by anything, and the aspiration object M then quickly comes off the surface where it has remained. As a result, excellent aspiration and removal performance is exhibited. Moreover, since in this state the ambient outside air is introduced with substantial force into the nozzle, the liquid W which has collided with the aspiration object M will not disperse outside.

When the nozzle is moved away from the surface with the residual aspiration object M while the liquid W is being ejected, the internal pressure of the nozzle body 60*a* immediately rises. In other words, a pressure difference between the atmospheric pressure and the internal pressure (that is, negative pressure) of the nozzle body 60*a* decreases to a value equal to or less than an operating threshold value of the driving device 65. Accordingly, the liquid injection device body 67*a*, tilts to return to the horizontal state. As a result, the liquid ejected from the liquid injection device body 67*a'* collides with and is blocked by the shielding plate 63' as shown in FIG. 25, and the liquid droplets are then immediately aspirated.

The liquid W ejected from the liquid injection device body 67*a'* is reversed within the nozzle body 60*a* and will not be discharged outside through the opening 61. Consequently, even if the nozzle 60 is moved away from the surface with the residual aspiration object M during the aspiration and removal work while the liquid W is being ejected, the liquid W will never disperse around. Therefore, such a problem of soiling the surroundings with the dispersed liquid W will never occur.

The nozzle 60' structured in this manner does not require any complicated control system which uses, for example, a sensor in order to achieve such special effects as described above. Accordingly, the structure of the nozzle is very simple and, therefore, it is possible to provide the nozzle at low cost. Moreover, even if the nozzle is moved away from the surface with the residual aspiration object during the aspiration work while the liquid is being ejected, the liquid will not disperse around. Furthermore, the flexible tube 82 may certainly be made in an accordion form.

What is claimed is:

1. A nozzle connected to an aspirator and used for aspirating an aspiration object, the nozzle comprising:

a nozzle body including an opening, which can be opposed to a surface with a residual aspiration object, and a suction port for aspirating the aspiration object; and a liquid injection mechanism for ejecting liquid toward the aspiration object, the liquid injection mechanism provided at the nozzle body, wherein the liquid injection mechanism comprises a barrier plate provided within the nozzle body and substantially in parallel with the opening, and the barrier plate has a smaller surface area than a sectional area of a cavity of the nozzle body at a position where the barrier plate is provided, and the barrier plate has a liquid injection hole formed therein for ejecting the liquid toward the aspiration object.

2. A nozzle according to claim 1, wherein an outside-air inlet for introducing outside air into the nozzle body is formed on an end face of the opening, which is opposed to the surface with the residual aspiration object.

3. A nozzle according to claim 2, wherein a plurality of projections are formed in a peripheral direction of the end face of the opening and spaces between the projections constitute the outside-air inlet.

4. A nozzle according to claim 2, wherein the liquid injection hole for ejecting the liquid toward the aspiration object is formed around the opening and on the end face opposed to the aspiration object.

5. A nozzle according to claim 1, wherein the liquid injection hole is formed on a surface of the barrier plate, which is opposed to the surface with the residual aspiration object.

6. A nozzle according to claim 1, characterized in that the aspiration object is residual excrements on the human body.

7. An aspirator equipped with the nozzle stated in claim 1, the aspirator comprising:

an aspirating mechanism communicating with the suction port of the nozzle;

an aspiration object tank for storing the aspiration object aspirated through the nozzle by operation of the aspirating mechanism; and a liquid supply mechanism for supplying liquid to the liquid injection mechanism of the nozzle;

wherein the liquid sprayed from the liquid injection mechanism on the aspiration object, and the aspiration object are aspirated through the suction port of the nozzle by the operation of the aspirating mechanism and are then stored in the aspiration object tank.

8. An aspirator according to claim 7, wherein the liquid supply mechanism comprises:

a liquid tank for storing the liquid;

a liquid communicating passage for making the liquid tank communicate with the liquid injection mechanism; and a liquid pumping mechanism for pumping the liquid stored in the liquid tank into the liquid injection mechanism.

9. An aspirator according to claim 7, comprising an aspiration passage for making the aspiration object tank communicate with the nozzle.

10. An aspirator according to claim 8, further comprising a heating mechanism for heating the liquid stored in the liquid tank to a given liquid temperature.

11. An aspirator according to claim 7, wherein the nozzle is provided in a detachable manner.

12. A nozzle connected to an aspirator and used for aspirating an aspiration object, the nozzle comprising a nozzle body including an opening, which can be opposed to a surface within a residual aspiration object, and a suction port for aspirating the aspiration object, a liquid injection mechanism for ejecting liquid toward the aspiration object, the liquid injection mechanism provided at the nozzle body, wherein the liquid injection mechanism includes:

a shielding plate which is provided within the nozzle body, which is capable of displacing in a direction perpendicular to an axial direction of the nozzle body, and with which the ejected liquid can collide; and a driving mechanism connected to the shielding plate and designed to displace the shielding plate by utilizing a pressure difference between a pressure within the nozzle body and atmospheric pressure when the pressure within the nozzle body becomes a negative pressure;

wherein the driving mechanism operates and displaces the shielding plate, thereby the ejected liquid is discharged outside without colliding with the shielding plate.

13. A nozzle according to claim 12 wherein the driving mechanism comprises:

an annular glide wall mounted around a hole formed in an outer surface of the nozzle body;

a piston member provided in the guide wall in such a manner displaceable relative to the guide wall;

a shaft member for connecting the piston member with the shielding plate; and a restoring member for exerting a restoring force on the piston member in a direction so as to move the piston member away from the inside space of the nozzle body;

wherein when pressure within the nozzle body becomes a negative pressure, the piston member is displaced by means of a pressure difference between the negative pressure and atmospheric pressure in a direction so as to move the piston member closer to the inside space of the nozzle body, and the displacement of the piston member causes the shielding plate to be displaced through an intermediary of the shaft member.

14. A nozzle accordingly to claim 13, wherein an open side of the guide wall, which is opposed to a principal plane of the piston member, is blocked by a film member which is impermeable to gas.

15. A nozzle according to claim 12, wherein a plurality of projections are formed in a peripheral direction on the end face of the opening.

* * * * *

UNITED STATES PATENT AND TRADEMARK OFFICE

CERTIFICATE OF CORRECTION

PATENT NO. : 6,938,838 B2
APPLICATION NO. : 09/730754
DATED : September 6, 2005
INVENTOR(S) : Eiichi Kawamoto It is certified that error appears in the above-identified patent and that said Letters Patent is hereby corrected as shown below:

On the title page, under item (73) Assignee, delete "Sanyo Rayjac Co., Ltd." and insert therefor --Sankyo Aqua System Co., Ltd.--.

Signed and Sealed this

Thirty-first Day of July, 2007

JON W. DUDAS
*Director of the United States Patent and Trademark Office*